US010035521B2

(12) United States Patent
Williams

(10) Patent No.: US 10,035,521 B2
(45) Date of Patent: Jul. 31, 2018

(54) COVERED HOPPER RAILCAR FOR CARRYING FLOWABLE MATERIALS

(71) Applicant: American Railcar Industries, Inc., St. Charles, MO (US)

(72) Inventor: Michael R. Williams, Creve Coeur, MO (US)

(73) Assignee: American Railcar Industries, Inc., St. Charles, MO (US)

( * ) Notice: Subject to any disclaimer, the term of this patent is extended or adjusted under 35 U.S.C. 154(b) by 586 days.

(21) Appl. No.: 14/596,657

(22) Filed: Jan. 14, 2015

(65) Prior Publication Data

US 2015/0197257 A1 Jul. 16, 2015

Related U.S. Application Data

(60) Provisional application No. 61/927,274, filed on Jan. 14, 2014.

(51) Int. Cl.
*B61D 7/00* (2006.01)
*B61D 7/02* (2006.01)

(52) U.S. Cl.
CPC ..... *B61D 7/02* (2013.01); *Y10T 29/49622* (2015.01)

(58) Field of Classification Search
CPC ... B61D 7/00; B61D 7/02; B61D 7/04; B61D 7/14
USPC ..... 105/250
See application file for complete search history.

(56) References Cited

U.S. PATENT DOCUMENTS 3,543,692 A * 12/1970 Marvin ..... B61D 7/02 105/248
3,713,400 A * 1/1973 Teoli ..... B61D 9/00 105/406.1
4,254,714 A * 3/1981 Heap ..... B61D 7/00 105/364
4,312,607 A * 1/1982 Van Auken ..... B65D 90/545 222/554
4,440,528 A * 4/1984 Mowatt-Larssen .... B65G 53/18 406/90
4,727,814 A * 3/1988 Nielsen ..... B61D 17/02 105/1.1
4,941,411 A * 7/1990 Wong ..... B61D 7/02 105/410
5,232,315 A * 8/1993 Dugge ..... B61D 5/004 105/247

(Continued)

OTHER PUBLICATIONS

Novelli, F. et al., "A quick look at pneumatic conveying system basics," Powder and Bulk Engineering, Mar. 2010, www.powderbulk.com (3 pgs).

*Primary Examiner* — Jason C Smith
(74) *Attorney, Agent, or Firm* — Armstrong Teasdale LLP

(57) ABSTRACT

A covered hopper railcar includes a roof portion and a plurality of side portions coupled to the roof portion. The plurality of side portions and the roof portion at least partially define a longitudinal centerline axis and a transverse centerline axis that is substantially perpendicular to the longitudinal centerline axis. The covered hopper railcar also includes a bottom assembly coupled to the side portions. The bottom assembly includes a plurality of bottom side sheets and a trough assembly coupled to the plurality of bottom side sheets. The trough assembly is substantially parallel to and substantially aligned with the longitudinal centerline axis.

26 Claims, 20 Drawing Sheets

(56) References Cited

U.S. PATENT DOCUMENTS

| | | | | |
|---|---|---|---|---|
| 5,253,593 | A * | 10/1993 | Kurtz | B61D 7/00 105/355 |
| 6,279,217 | B1 * | 8/2001 | Gallinger | B23K 37/0229 29/281.1 |
| 7,988,386 | B2 * | 8/2011 | Sisk | B60P 3/225 285/133.11 |
| 8,240,256 | B2 * | 8/2012 | Nutt | B61D 7/00 105/239 |
| 2003/0200895 | A1 * | 10/2003 | Forbes | B61D 3/18 105/355 |
| 2004/0173118 | A1 | 9/2004 | Forbes | |
| 2005/0126426 | A1 | 6/2005 | Forbes | |

* cited by examiner

COVERED HOPPER RAILCAR FOR CARRYING FLOWABLE MATERIALS

CROSS REFERENCE TO RELATED APPLICATIONS

This application claims the priority of Provisional Patent Application Ser. No. 61/927,274, entitled "COVERED HOPPER RAILCAR FOR CARRYING FLOWABLE MATERIALS", which was filed on Jan. 14, 2014, and which is hereby incorporated by reference in its entirety.

BACKGROUND

The field of the disclosure relates generally to railway cars and related components, and more particularly to a covered hopper railcar for carrying flowable materials including solid and semi-solid materials, and a method of manufacturing and operating the same.

Railway cars have been used for many years to transport a wide variety of materials. For example, covered hopper railcars transport solid flowable materials such as, for example, plastic pellets. Many known covered hopper railcars include roof hatches, bottom outlets with outlet gates, and multiple internally partitioned hoppers to facilitate gravity loading and gravity unloading of the solid flowable materials. Each hopper of the multiple hoppers included within a known railcar typically has one bottom outlet. However some known covered, multiple-hopper railcars use a gravity pneumatic outlet designed for transport of granular products such as, for example, plastic pellets from each hopper to a remote storage bin. The gravity pneumatic outlet is typically coupled to a pneumatic conveying system found at the unloading site. Gravity causes the pellets inside the hopper to flow into the outlet's product tube. A pneumatic conveying system then conveys the plastic pellets into storage silos, hoppers, or other containment devices, using a dilute phase type system that suspends the pellets in an air stream by using high-velocity and low-pressure air.

The configuration of each hopper (e.g., the size, shape, and angle to the outlets) within a covered hopper railcar is controlled by the product's angle of slide (i.e., the angle required to get the product to flow to the outlet gate under the action of gravity alone). However, unlike a gravity-only discharge outlet, the product in a multiple hopper railcar is not unloaded directly under the hopper. Rather, it is pneumatically conveyed laterally to a silo or process bin. Hence unloading a conventional covered hopper car with gravity pneumatic outlet gates necessitates coupling and uncoupling the unloading system to and from each hopper individually. This coupling and uncoupling is time consuming and labor intensive, thereby increasing the costs of unloading.

Moreover, to meet the angle of slide to the outlet, the hoppers must diverge longitudinally, which creates a saw-tooth shape when viewed from the side of the railcar. The saw-tooth configuration is the consequence of the hopper slopes needed to get the product to slide toward the outlet. Unusable interior space is formed by the diverging slopes of adjacent hoppers. The hopper saw-tooth shape also reduces the usable volume. This lost space translates into the requirement for a longer car to hold an equivalent volume or payload. A longer car increases the difficulty in transit of negotiating curves. A plurality of longer railcars increases the overall length of the train, thereby limiting the number of cars in certain trains that are limited by overall train length.

The saw-tooth shape also reduces the effectiveness of the car body and its hoppers from transmitting car-to-car train action loads. Consequently, these known railcars require a more substantial structural member (i.e., either a center sill or a side sill) to transmit train action longitudinal loads. Furthermore, railcar body bending loads are less efficiently carried by the saw-tooth design of the hoppers, because the effective bending section is limited to the height of the side sheet, rather than the entire depth of the car body.

BRIEF DESCRIPTION

In one aspect, a covered hopper railcar is provided. The covered hopper railcar includes a roof portion and a plurality of side portions coupled to the roof portion. The plurality of side portions and the roof portion at least partially define a longitudinal centerline axis. The covered hopper railcar also includes a bottom assembly coupled to the side portions. The bottom assembly includes a plurality of bottom side sheets and a trough assembly coupled to the plurality of bottom side sheets. The trough assembly is substantially parallel to and substantially aligned with the longitudinal centerline axis.

In another aspect, a method of assembling a covered hopper railcar is provided. The method includes providing an integrated roof portion and a plurality of side portions coupled to the roof portion. The plurality of side portions and the roof portion at least partially define a longitudinal centerline axis. The method also includes coupling a bottom assembly to the plurality of side portions. The bottom assembly includes a plurality of bottom side sheets coupled to the plurality of side portions and a trough assembly coupled to the plurality of bottom side sheets. The trough assembly is substantially parallel to and substantially aligned with the longitudinal centerline axis.

In another aspect, a method of unloading a solid flowable material from a covered hopper railcar is provided. The railcar includes a plurality of bottom side sheets that define at least a portion of a material transport cavity and a longitudinal centerline axis. The plurality of bottom side sheets are coupled to a trough assembly that is positioned substantially parallel to and substantially aligned with the longitudinal centerline axis. The trough assembly is coupled to a transversely oriented material transport system at the center of the car. The method includes coupling a material receiving system to the material transport system and coupling a first portion of the material transport cavity to the material receiving system through a first portion of the trough assembly. A first portion of a solid flowable material is then transported from the first portion of the material transport cavity along the longitudinal centerline axis via the trough assembly. The first portion of the solid flowable material is then transported from the first portion of the trough assembly to the material transport system. The first portion of the solid flowable material is then conveyed into the material receiving system.

DRAWINGS

FIG. 1 is a schematic overhead view of an exemplary railcar;

FIG. 2 is a schematic side view of the railcar shown in FIG. 1;

FIG. 3 is a schematic perspective overhead view of the railcar shown in FIGS. 1 and 2;

FIG. 4 is a schematic perspective bottom view of the railcar shown in FIGS. 1 through 3;

FIG. 5 is a schematic perspective cross-sectional view of a portion of the railcar shown in FIGS. 1 through 4;

FIG. 6 is a schematic cross-sectional view of the railcar shown in FIGS. 1 through 5;

FIG. 7 is a schematic view of a portion of the railcar shown in FIGS. 1 through 6 suspended from a frame during manufacture;

FIG. 8 is an exemplary hoop that may be used with the railcar shown in FIGS. 1 through 7.

FIG. 9 is a schematic cross-sectional view of the hoop shown in FIG. 8;

FIG. 10 is a schematic perspective end view of a portion of the railcar shown in FIGS. 1 through 7;

FIG. 11 is a schematic perspective view of an exemplary stub sill subassembly that may be used with the railcar shown in FIGS. 1 through 7;

FIG. 12 is a schematic perspective view of an exemplary underframe assembly that may be used with the railcar shown in FIGS. 1 through 7;

FIG. 13 is a schematic perspective view of an exemplary shear plate that may be used with the underframe assembly shown in FIG. 12;

FIG. 14 is a schematic perspective view of an exemplary bottom assembly that may be used with the railcar shown in FIGS. 1 through 7;

FIG. 15 is a schematic end outline view of the bottom assembly shown in FIG. 14;

FIG. 16 is a schematic perspective view of an exemplary trough that may be used with the bottom assembly shown in FIG. 14;

FIG. 17 is a schematic end view of the trough shown in FIG. 16;

FIG. 18 is a schematic perspective overhead view of a portion of an exemplary material transport system that may be used with the bottom assembly shown in FIG. 14;

FIG. 19 is a schematic perspective bottom view of the portion of the material transport system shown in FIG. 18;

FIG. 20 is a schematic perspective bottom view of an exemplary piping manifold assembly that may be used with the material transport system shown in FIGS. 18 and 19;

FIG. 21 is a schematic perspective view of an alternative piping manifold assembly that may be used with the material transport system shown in FIGS. 18 and 19;

FIG. 22 is a schematic perspective view of another alternative piping manifold assembly that may be used with the material transport system shown in FIGS. 18 and 19;

FIG. 23 is a schematic perspective overhead view of the material transport system shown in FIGS. 18 through 20; and FIG. 24 is a schematic perspective overhead view of an alternative material transport system that may be used with the bottom assembly shown in FIG. 18 with the alternative piping manifold shown in FIG. 21.

DETAILED DESCRIPTION

Figure 1:
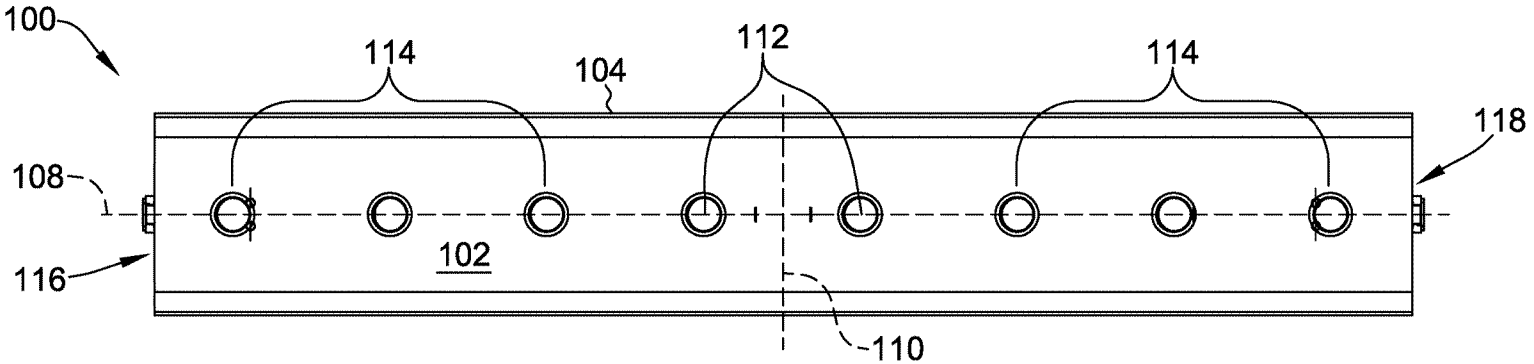
FIGS. 1-24 show exemplary embodiments of the apparatus and methods described herein.

The exemplary methods and apparatus described herein overcome at least some disadvantages of known railway cars by providing a covered hopper railcar configured to increase loading and unloading efficiencies and decrease costs of transporting solid and semi-solid flowable materials (e.g., plastic pellets) in bulk. The covered hopper railcar disclosed herein includes a trough assembly at the bottom center of the railcar that receives gravity-fed material. The covered hopper railcar disclosed herein also includes a piping manifold coupled in flow communication with the trough. The piping manifold is coupled to a pneumatic conveying system that directs the product to the center of the car where it is transferred to the unloading facility's conveying system.

The covered hopper railcar disclosed herein significantly reduces the weight of covered hopper railcars. Since the railcar disclosed herein eliminates the saw-tooth design of a conventional gravity discharge covered hopper car, the need to compensate for the multiple-hopper induced discontinuities to carry bending loads and train action forces is eliminated, such compensation taking the form of robust structures such as a semi-monocoque bottom assembly. The term "monocoque" typically refers to a structure that is configured to use a thin outer shell, or skin, wherein a substantial portion of the overall mechanical weight and stress loading of the structure is carried by the outer shell with little to no internal support features. A monocoque configuration may be compared to a more typical configuration that utilizes a load-bearing internal framework. As such, as used herein, a semi-monocoque configuration includes a load-bearing outer structure in cooperation with a load-bearing internal framework.

More specifically, the covered hopper railcar disclosed herein uses spiral technology to fabricate the sides and roof of the railcar as one unitary piece. The sides and roof are first formed as a closed spiral-wound cylinder. The cylinder is split and draped over spaced-apart hoops and end floors, then fitted to close up any gaps. The spiral-wound technology will provide "ribbed" stiffness, which will enable the use of a thinner side gauge than in known railcars. Further, using a rounder side and roof profile in conjunction with eliminating sub-arc side sheet welds that are susceptible to heat distortion will significantly decrease the undesirable condition of side sheet buckling. The covered hopper railcar disclosed herein is specifically designed to resist car bending loads. Specifically, the deep longitudinal bottom assembly creates a higher moment of inertia and hence significantly reduces the need for not only side sills but also the need for a top chord, as described in further detail below. The smooth transition of the cross section from the roof to the sides and from the sides to the bottom assembly significantly reduces the need for framing members used in known conventional covered hoppers to assure that the side shape is maintained while the railcar is loaded with product.

Longitudinal train action loads are typically transmitted through the lower half of the railcar. By extending the effective load carrying portion of the railcar from a localized region proximate the side sills to a larger portion of the lower portion of the side walls and the trough assembly, the need to increase the cross sectional area and hence the weight of the side sills and other load bearing members is eliminated, thereby facilitating a lighter railcar. By tying in the shear plate to the end floor, the shear plate load is transferred over the entire width of the car body. This improvement over known hopper railcars overcomes the local concentration of load transfers from the shear plate to the side sill in a conventional stub sill covered hopper car.

As the load-carrying cross section of the body is essentially in line with the train action loads, the need for an elaborate end structure used to react to overturning moments is substantially reduced. Rather, a simple end post is used to transfer the smaller load reactions to the end wall.

The internal hoops of the railcar disclosed herein add stability by reducing the unsupported longitudinal length of the railcar, and hence they increase the buckling resistance under squeeze loads (i.e., those loads exerted on the railcar when compressed due to braking or run-in train action).

Another effect of the design of the covered hopper railcar disclosed herein is the elimination of the top chords that are used in conventional railcars at the junction of the side walls to the roof. The railcar disclosed herein addresses at least three of the reasons for the top chords of the covered railcar. First, in known conventional railcars, the top chords act as the top flange of the side sheet I-beam to transmit car bending loads to the body bolster and trucks. Second, the top chords act as a framing member to enable the nearly square corner connection of the side sheets to the roof sheet. Third, on known conventional stub sill cars, the top chord transmits the axial loads that react to the overturning moments caused by the vertical misalignment of the side sill and center sill. The trough-based covered hopper railcar disclosed herein utilizes the bottom assembly to transmit car bending loads. Therefore the first-function of the top chords to act as the top flange of an I-beam side sheet is not needed. The trough assembly-based covered hopper railcar has a rounded transition from the roof to the side sheet with a generous radius. Hence a framing member to facilitate a sharp transition is not needed, and so the second demand of the top chords falls away. Thirdly, because the coupler centerline is nearly in line with the centroid of the bottom assembly, smaller overturning moments occur, and so the top of the car can transmit the reaction couple without the need for separate and distinct top chords.

A further effect of the design of the covered hopper railcar disclosed herein is an improvement in the effective service life of the railcar. Specifically, the above-noted features that align the load paths improve the strength, more evenly distribute the loads, and eliminate obstructions that led to concentrated loading. The overall benefit of these enhancements is an improvement in the overall fatigue life.

The covered hopper railcar disclosed herein also reduces the overall length of the railcar. For example, for a 6200 cubic foot ($ft^3$) railcar, the car body length is reduced by about 3 feet (ft.) from standard, known covered hopper railcars. Such a length reduction of 3 ft. means that 25 trough railcars will fit in the same space as 24 known conventional railcars. The shorter car has a benefit at the loading and unloading points for the shipper and end user (i.e., more cars can fit on existing sidings). Fewer cars then either have to be put into storage and/or track requirements in the facility do not have to be as extensive. For the railroad that moves the cars, train length is often limited by the maximum train length that will fit into a main line siding. So, if a siding limits a conventional train to 96 cars, a train of trough-based hopper railcars could fit 100 cars. These four (4) additional cars offer revenues far in excess of the marginally higher fuel costs. Also, by increasing the usable volume per unit length, the railcar requires less structural material, thereby creating more available space for the transported product while decreasing the tare weight of the railcar. A shorter car also reduces the bending moment caused by vertical loads which in turn translates into a lighter car body.

The covered hopper railcar disclosed herein further facilitates faster and more effective loading and unloading. For loading, the open interior without the hopper divisions' removes the requirement that each of the multiple hoppers be loaded separately. For example, a conventional known covered hopper railcar for transporting plastic pellets requires loading through 10 separate hatches (also referred to herein as "loading openings") to achieve approximately a 98% fill. With the open interior cavity as disclosed herein, approximately an 80% fill can be achieved by loading at one of the loading openings/hatches at the center of the car. The remaining volume will be filled through top-off openings at the ends of the railcar, thereby reducing the number of start/stop of product loadings from 8-10 for most known hopper cars to 3 for the covered hopper railcar described herein. For unloading, the open interior cavity and central trough assembly discharge requires just one hook-up of an external pneumatic unloading system, thereby decreasing the number of hookups from four to one. Reducing the number of hook-ups reduces spillage, and requires fewer connection/disconnection operations by the workers. The material discharge pipe is also located further out from the center of the car, which enables the worker to make the connection without bending to get under the car, thus the new manifold piping assembly generates better ergonomics. Because the trough assembly disclosed herein features dilute phase unloading, the pellet unloading will be consistent with standard gravity pneumatic outlets.

Furthermore, the covered hopper railcar disclosed herein facilitates more efficient and more complete internal clean-out. Specifically, by eliminating gasket connections at the outlet mounting frame, the possibility of leaving entrapped particles is eliminated. Further, by removing the valleys, the intersections of floor slope and side slope sheets, the potential to leave granules hung up in these crevices is eliminated. By designing out these entrapments, the labor needed to drop the outlets to assure full clean-out of the railcar is eliminated.

Moreover, the covered hopper railcar disclosed herein facilitates reducing life cycle maintenance costs by eliminating the mounting frames, gaskets, and outlets associated with the product discharge features of standard known gravity pneumatic discharge covered hopper railcars. Also, by replacing the hopper partitions with hoops, the root cause of lining failures is eliminated. Specifically, traditional covered hoppers feature full-width partitions that restrict the free flow of plastic pellets from one hopper to another. This partition wall however is laterally loaded from car coupling operations and these loads produce flexing of the partitions and side sheets. Such flexing induces crack formation in the lining, thereby leading to a free path to the steel substrate, and subsequently inducing localized rust formation that in turn downgrades the value of the plastic pellets. The hoops provide the same stiffness as the partitions to maintain the cross-sectional shape but offer no resistance to longitudinal pellet movement.

Another savings occurs in that the trough-based covered hopper disclosed herein reduces the number of vented required from four to two. Specifically, conventional covered hopper railcars require one vented hatch per compartment. However the trough-based covered hopper disclosed herein, with its open interior, requires only two vented hatches for the entire car. This benefit lies not only in initial savings but also in halving the gasket and screen replacement costs over the life of the railcar.

In addition, the covered hopper railcar disclosed herein facilitates a resistance to tampering. Specifically, many known conventional outlets are subject to tampering through overcoming the outlet discharge plastic cap. The trough system disclosed herein reduces eight potential tamper points to merely two, and these two pipe outlets will be sealed with a rigid cap that cannot be removed without breaking the car seals.

The covered hopper railcar disclosed herein facilitates attaining additional clearance between the lowest portion of the product containment portions of the railcars disclosed herein and the ground. Specifically, a conventional gravity pneumatic outlet typically has a ground clearance of less than 8 inches. The low ground clearance makes it more likely that a conventional outlet is damaged by track obstructions such as switches or damaged by plant handling equipment such as car pullers. The trough-based covered hopper railcar described herein is configured to have an empty car height above the rails of approximately 15 inches, thereby reducing a potential for clearance-related repair costs.

Moreover, the covered hopper railcar disclosed herein lowers the center of gravity (CG). Specifically, by eliminating the hopper partitions, the dead space between hoppers of a known conventional covered hopper railcar are also eliminated. By replacing this formerly dead space with usable space filled with plastic pellets, the empty and loaded car's center of gravity is lowered. Lowering the CG translates into better stability in roll, curving, and pitch and bounce regimes. In other words, the car is easier to handle and less likely to derail. In addition, by eliminating the dead space between hoppers of a known conventional car, as described above, the overall length is reduced by three feet. Shortening the railcar improves its ability to negotiate curves at low speeds.

Furthermore, the trough-based covered hopper railcar disclosed herein is well suited to be equipped with truck-mounted brakes. Such truck-mounted brakes eliminate body levers and their inherent efficiency losses. The result is a more reliable brake system with equal loads applied at each wheel. Equalizing the braking force to each wheel will extend the wheel life.

The covered hopper railcar disclosed herein facilitates lowering the costs of manufacturing by eliminating or simplifying a number of components. For example, as compared to known conventional railcars, the railcars disclosed herein have eliminated diagonal stiffener end assemblies, hopper partition assemblies, side slope sheets, top chords, at least some hatch covers and rings, hopper discharge mounting frames, and hopper outlet assemblies.

The covered hopper railcar disclosed herein enables the following components to be greatly simplified. The end of car underframe features a stub sill subassembly with a C-channel configuration rather than the fabricated plate weldment used on a conventional stub sill covered hopper railcar. Also, for example, because the concentrated transfer of train action loads to the side sill is eliminated, the shear plate can be lightened. Further, for example, by eliminating the diagonal stiffeners that were needed to react the overturning moment, the upper bolster web is now one piece rather than three. Again, for example, by utilizing the bottom assembly to carry car body internal loads, the side sill can be lightened and so designed to facilitate car assembly.

Also, the fabrication and manufacturing time and activities associated with the railcars described herein decreases the opportunities for defects, including weld defects, as well as the labor costs. Moreover, consumption of consumables, such as, for example, welding rods and shielding gasses, is significantly reduced.

In addition to the reduced capital expenditures in the initial manufacturing of the railcar described herein, subsequent costs associated with maintaining spare parts inventories, storage facilities, preventative maintenance, and corrective maintenance are reduced as well, thereby facilitating an overall decrease in the total cost of ownership.

Figure 2:
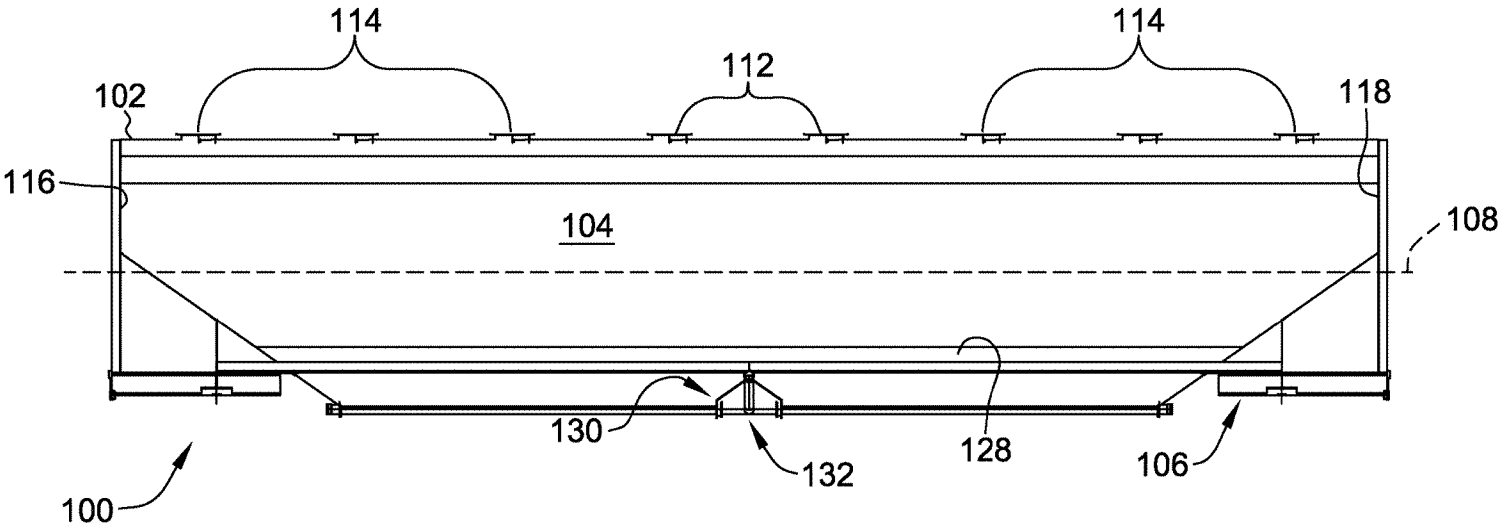

FIG. 1 is a schematic overhead view of an exemplary covered hopper railcar 100. FIG. 2 is a schematic side view of the covered hopper railcar 100. In the exemplary embodiment, the covered hopper railcar 100 is configured to carry plastic pellets. Alternatively, the railcar 100 can be used to carry any solid flowable material that facilitates operation of the railcar 100 as described herein, such as, but not limited to resins, fly ash, and grains. The exemplary railcar 100 includes a roof portion 102, a plurality of side portions 104 coupled to the roof portion 102, and a bottom assembly 106 coupled to the side portions 104. The side portions 104 and the roof portion 102 together at least partially define a longitudinal centerline axis 108. The railcar 100 also includes a transverse centerline axis 110 that is substantially perpendicular to the longitudinal centerline axis 108.

Defined in the roof portion 102 of the railcar 100 is a plurality of material loading openings or hatches including primary loading openings 112 and a plurality of secondary or top-off loading openings 114. In the exemplary embodiment, the roof portion 102 defines eight evenly-spaced round openings 112, 114 such that the center of each opening 112, 114 is spaced approximately 93 inches (in.) away from the center of an adjacent opening 112, 114. Alternatively, the roof portion 102 may define other evenly-spaced round openings 112, 114, for example six, seven, nine, or ten as appropriate for the product being loaded. Generally, the roof portion 102 may define as many loading openings 112, 114 as necessary and may not necessarily be round. For example, the loading opening may be a series of oval openings or one long continuous slot to facilitate operation of the railcar 100 as described herein.

In the exemplary embodiment, the plurality of primary loading openings 112 includes two openings 112 that are positioned approximately mid-way along the roof portion 102 proximate the transverse centerline axis 110. Through these two primary loading openings 112 the railcar 100 may be filled up to approximately 80% of its maximum load. The secondary or top-off loading openings 114 are positioned longitudinally at predetermined distances along the roof portion 102 from the primary loading openings 112 and are configured to facilitate loading the remainder of the railcar 100 that has not already been filled through the primary loading openings 112. Compared to known railcars, the loading time through the top-off openings 114 is shorter in duration because a conventional covered hopper car has two, three, or four compartments, which requires that each compartment be loaded separately.

Figure 3:
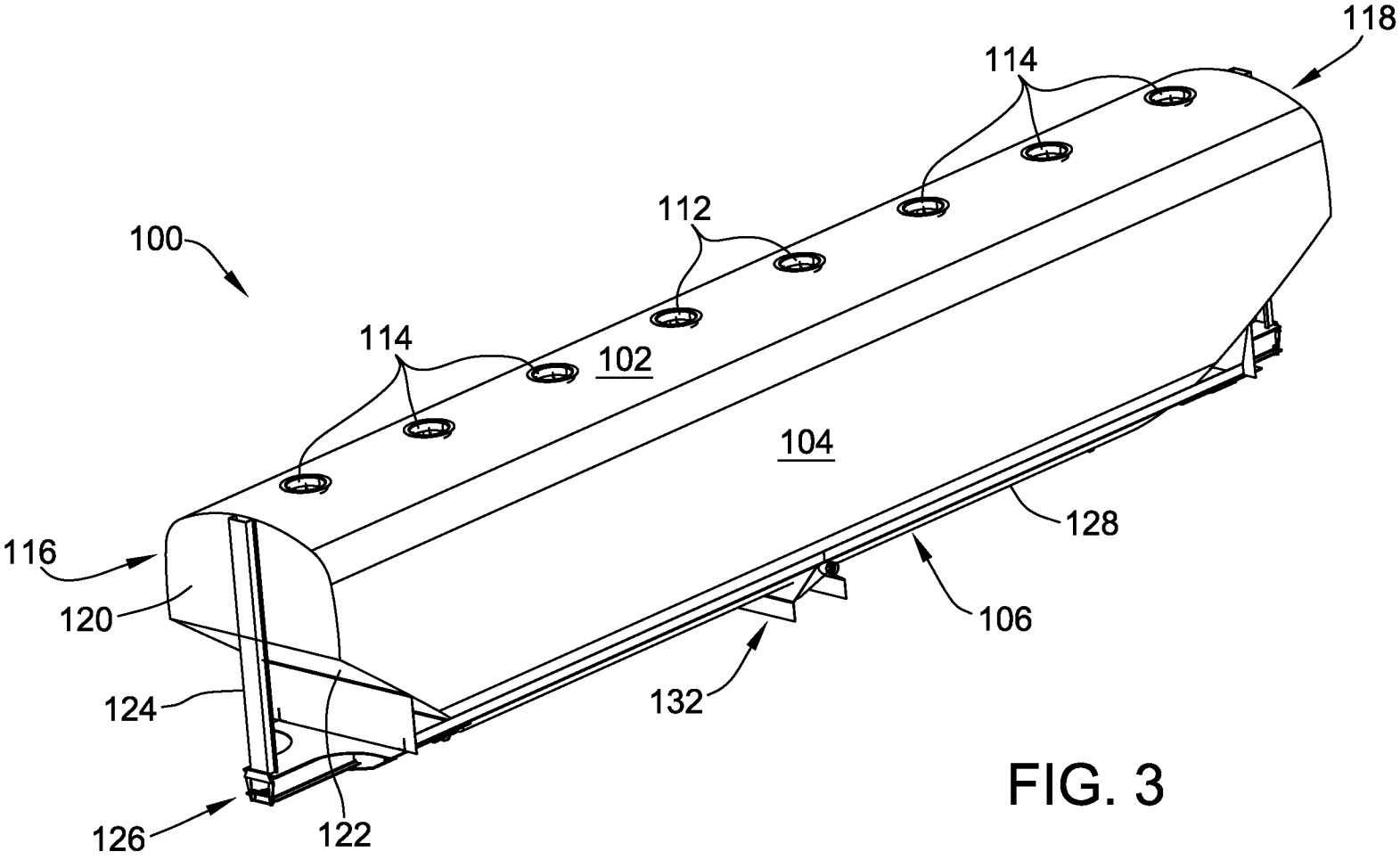
Figure 4:
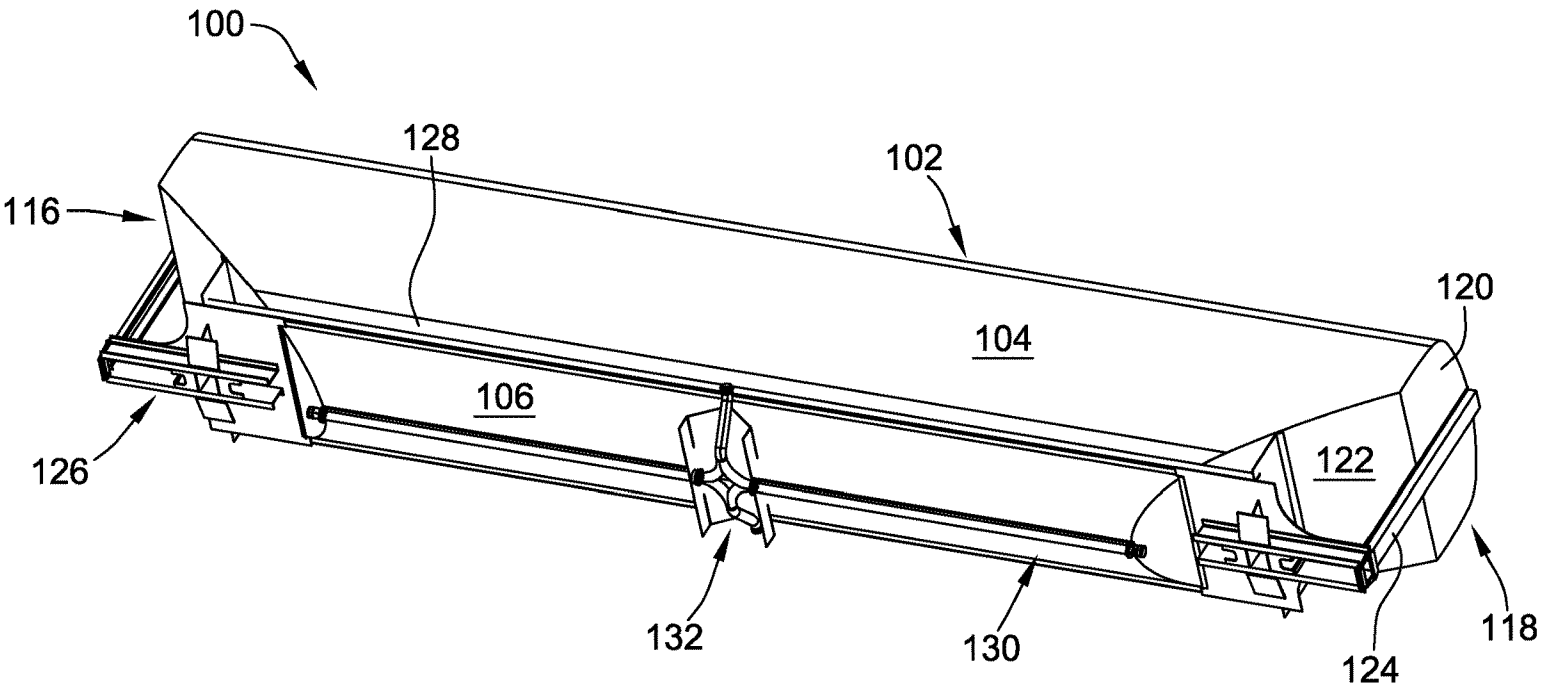

FIG. 3 is a schematic perspective overhead view of railcar 100. FIG. 4 is a schematic perspective bottom view of railcar 100. In the exemplary embodiment, the covered hopper railcar 100 also includes opposing first and second longitudinal ends 116, 118. Each longitudinal end 116, 118 includes an end wall 120 coupled to the roof portion 102 and to the side portions 104 such that the end wall 120 is substantially vertical. Each longitudinal end 116, 118 also includes an end floor 122 that is integrally joined to each end wall 120 at a predetermined angle such that the end floors 122 are sloped inward and downward toward the bottom assembly 106. The sloped orientation of end floors 122 facilitate movement of material contained in railcar 100 away from end wall 120 and toward transverse centerline axis 110 during loading into and removal from the railcar 100. Each longitudinal end 116, 118 further includes a supporting end post 124 that is coupled at a first end to and is substantially parallel with the end wall 120. Each end post 124 is coupled at a second opposing end to an underframe assembly 126 that includes a pair of side sills 128 that extend between the first and second longitudinal ends 116, 118. The end posts 124 are configured to replace the multiple diagonal stiffeners found on known stub sill covered hopper railcars and serve to react loads imparted from the underframe assembly 126.

The bottom assembly 106 defines a lower longitudinal length of the railcar 100 and includes a trough assembly 130 and a material transport system 132 that are configured to facilitate transporting the solid flowable material from within the railcar 100 to an external storage area or processing area. The trough assembly 130 extends between the first and second longitudinal ends 116, 118 such that it is substantially parallel to the longitudinal centerline axis 108 and includes a length that is substantially equal to the lower longitudinal length of the bottom assembly 106. As shown, the length of the trough assembly 130 extends between the first and second longitudinal ends 116, 118 and, more specifically, between the end floors 122 of each longitudinal end 116, 118. In other embodiments, the length of the trough assembly 130 may be any distance that facilitates operation of the covered railcar 100, such as, but not limited to, shorter than the distance between end floors 122.

In the exemplary embodiment, the covered hopper railcar 100 differs visually from conventional hopper railcars in that the exemplary railcar 100 includes only a single hopper that is oriented longitudinally, rather than a plurality of hoppers that are oriented transversely. The railcar 100 as disclosed herein has a length that is shorter than that of known railcars having a substantially similar volume. For example, for a 6200 $ft^3$ railcar 100, the overall length is reduced by about 3 ft. from standard, known covered hopper railcars. This reduction in length is due to the elimination of interior partition assemblies that utilize slope sheets to enable the product to gravity flow to the outlet. These partitions divide transversely-oriented hoppers on known railcars creating a saw-tooth design, which requires additional supporting structure to carry bending and train action forces. The railcar 100 as disclosed herein weighs less because it is shorter and also because the longitudinal hopper (i.e., the trough assembly 130) eliminates the saw-tooth design and therefore the need for the supporting structure to carry bending and train action forces. By being shorter, the railcar 100 described herein also allows more railcars 100 per train than standard length railcars. For example, if a conventional train is limited in length to 96 cars, a train of trough based hopper railcars 100 would be 100 cars in length. These four additional cars 100 offer increased revenues with only marginally higher fuel costs.

Alternatively, the covered hopper railcar 100 described herein may have a length that is substantially equal to that of known covered railcars. However, because the inwardly sloping hopper partitions are eliminated, the covered railcar 100 described herein has an increased usable volume per unit length such that the railcar 100 has an increased volume of 6,500 $ft^3$ rather than the standard 6200 $ft^3$. Accordingly, the volume of the exemplary covered hopper railcar 100 may be increased without extending the length of the railcar 100 beyond that of known hopper railcars.

Figure 5:
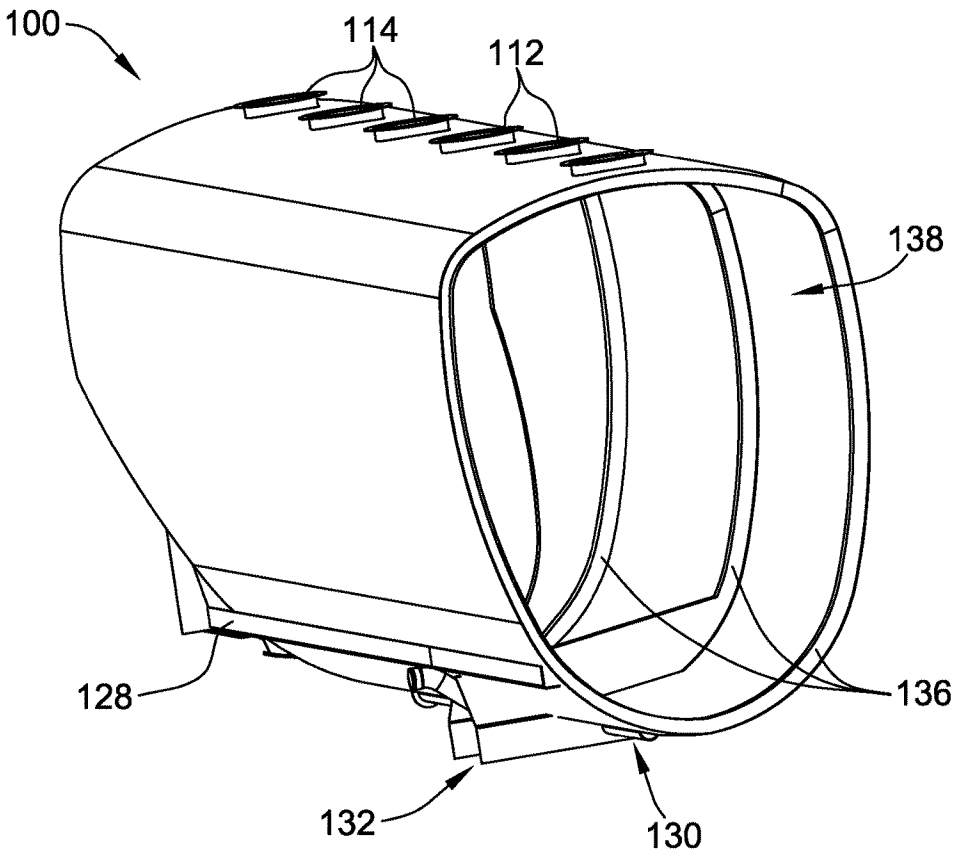
Figure 6:
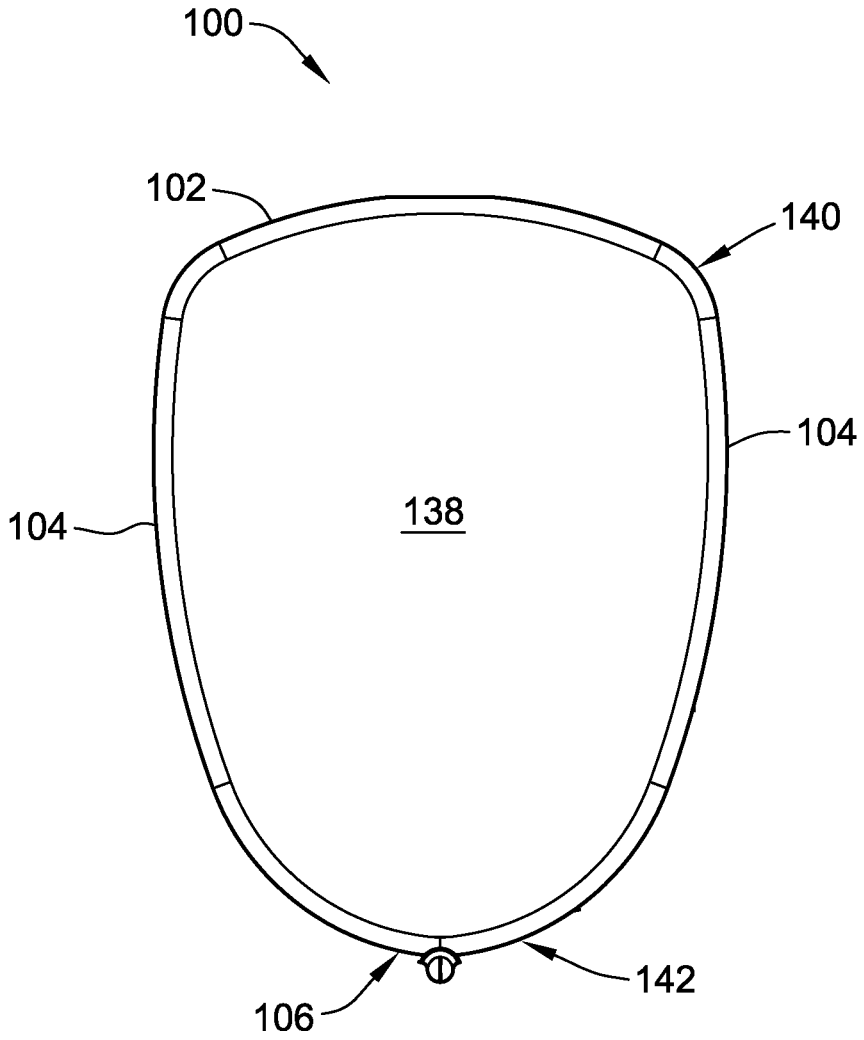
Figure 7:
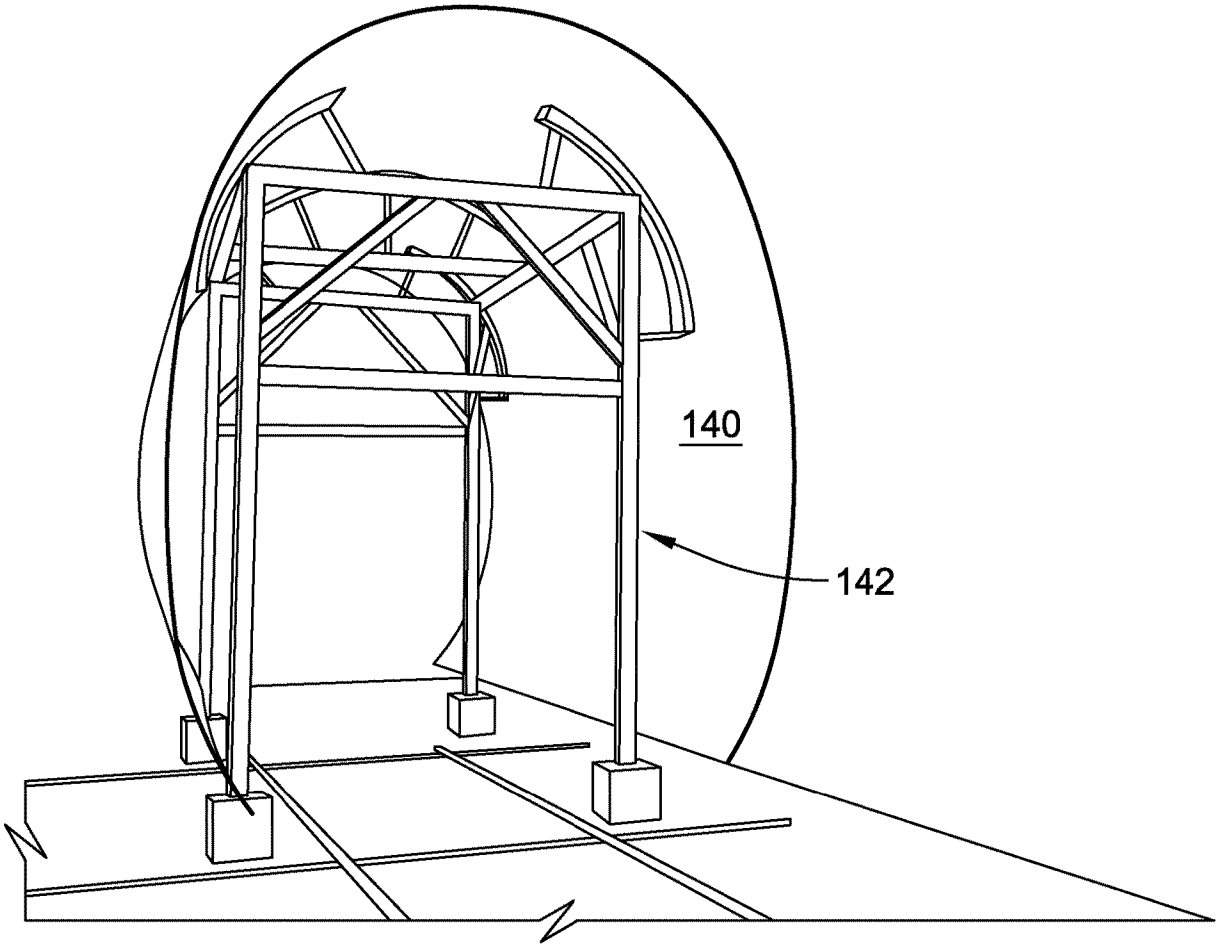

FIG. 5 is a schematic perspective cross-sectional view of a portion of the railcar 100 shown in FIGS. 1-4. FIG. 6 is a schematic cross-sectional view of the railcar 100 shown in FIGS. 1-5. FIG. 7 is a schematic view of a portion of the railcar 100 shown in FIGS. 1-6 suspended from a frame during manufacturing. In the exemplary embodiment, the covered hopper railcar 100 as disclosed herein is assembled by integrally forming the roof portion 102 with the plurality of side portions 104. This step includes fabricating a closed unitary cylinder, which defines the longitudinal centerline axis 108, using spiral-wound technology. A unitary roof and side wall assembly 144 is formed by splitting the cylinder along a line substantially parallel to the longitudinal centerline axis 108. The roof and wall assembly 144 is then draped over a frame apparatus 146 and flexed to achieve predetermined dimensions.

After the roof and wall assembly 144 is manufactured, it is removed from the frame apparatus 146 and draped over the pre-assembled bottom assembly 106, opposing end floors 122, the underframe assembly, and a plurality of hoops 136 (described in further detail below, with respect to FIGS. 8 and 9). The pair of side sills 128 is then coupled to the bottom assembly 106 and underframe assembly 126 such that the side sills 128 extend between the first and second longitudinal ends 116, 118. Finally, the plurality of material loading openings 112, 114 are cut into the roof portion 102.

In the exemplary embodiment, the roof portion 102, side portions 104, and bottom assembly 106 combine to at least partially define a material transport cavity 138 that is configured to contain the solid flowable material. As shown in FIG. 5, the material transport cavity includes a single, continuous, clean bore interior that does not include partitions that form multiple isolated hoppers within known railcars. The material transport cavity 138 includes a cross-section, as shown in FIG. 6, that is formed by four radii that facilitate a more efficient clean-out of the cavity 138 and also that eliminates the possibly of side and roof sheet buckling, which is more likely to occur as the side and roof sheet contours become flatter. A transition 140 between the roof portion 102 and the side portions 104 defines the smallest radius, which forms a natural transition 140 to enable the roof portion 102 and side portion 104 to drape easily during assembly. The rounded shape 142 of the bottom assembly 106 along the longitudinal centerline axis 108 eliminates the inwardly sloped side slope sheets of known covered railcars and, therefore, eliminates the shallow valley angle formed by the intersection of the side slope sheet to the partition slope sheet. By eliminating a shallow crevice which can retain product, the trough-based design of railcar 100 facilitates unloading without product retention. The rounded shape 142 of the bottom assembly 106 also increases the volume of the material per unit length of the railcar 100.

Figure 8:
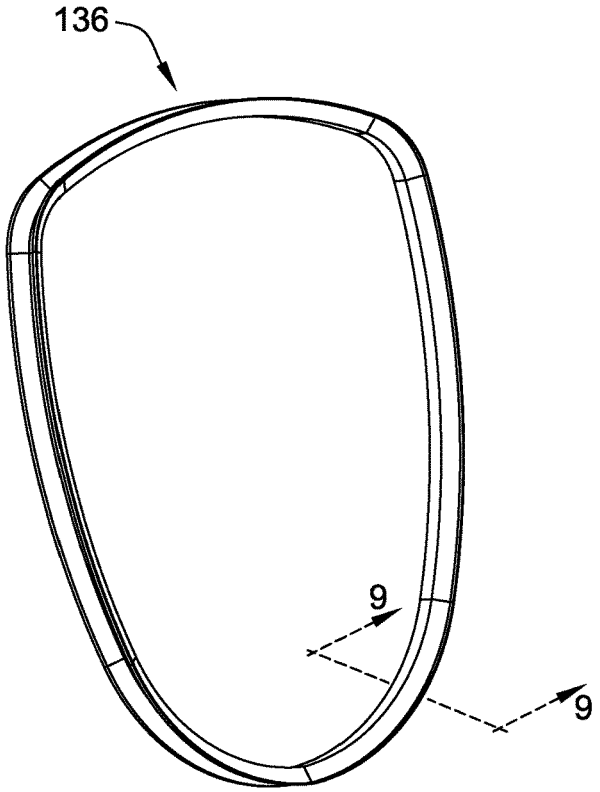
Figure 9:
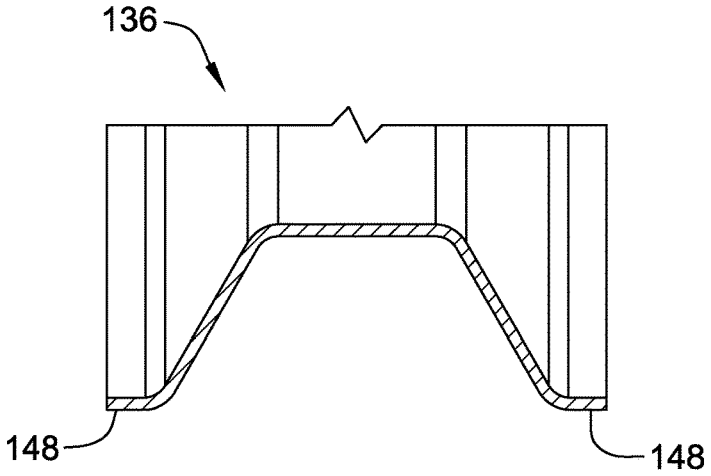

FIG. 8 is an exemplary hoop 136 that may be used with the railcar 100 shown in FIGS. 1-6. FIG. 9 is a schematic cross-sectional view of the hoop 136 shown in FIG. 8. Each of the roof portion 102, the side portions 104, and the bottom assembly 106 have an interior surface to which a plurality of hoops 136 are coupled. In the exemplary embodiment, each hoop 136 of the plurality of hoops 136 is a closed loop such that each hoop 136 forms a continuous outline of the material transport cavity 138 cross-section. The plurality of internal hoops 136 is spaced at predetermined intervals within the cavity 138 to provide structural support to the railcar 100 and reduce the length of any unsupported portion of the railcar 100. The interior hoop 136 further increases the buckling resistance of the railcar 100 under squeeze loads (i.e., those loads exerted on the railcar when subjected to train action compression forces). The plurality of hoops 136 replaces the hopper partitions found in known railcars, thus eliminating partition cracks and lining failures caused by the longitudinal movement of the material within isolated hoppers. Furthermore, the plurality of hoops 136 is coupled to the interior surface of the cavity 138 such that the trough assembly 130 extends longitudinally below the hoops 136 to allow the solid flowable material to flow freely within the cavity 138 beneath the hoops 136. Accordingly, the plurality of hoops 136 provides the same stiffness as the partitions of known railcars to maintain the cross-sectional shape of the exemplary railcar 100 but offers no resistance to longitudinal material movement.

Furthermore, each hoop 136 may be made in sections, for example, to precisely fit the radii of the roof portion 102, the side portion 104, and the bottom assembly 106. Each hoop 136 includes as few sections as possible to retain stiffness. Each section is made from a single piece having a hat-shaped cross-section. The hat depth creates section stiffness while free edge flanges 148 that join to the body of railcar 100 serve to gradually transition the stiffness and thereby prevent side sheet cracking, which is a problem with known covered hoppers. The smooth radii of the hat section also assure that the interior lining will remain adhered to the interior of the roof portion 102 and side portions 104 by decreasing the surface tension of the liner to decrease liner failures. At least some known hopper railcars include sharp corners that put the liner coating under increased surface tension, which results in a lining crack or delamination, either of which may lead to rust contamination of the material.

Figure 10:
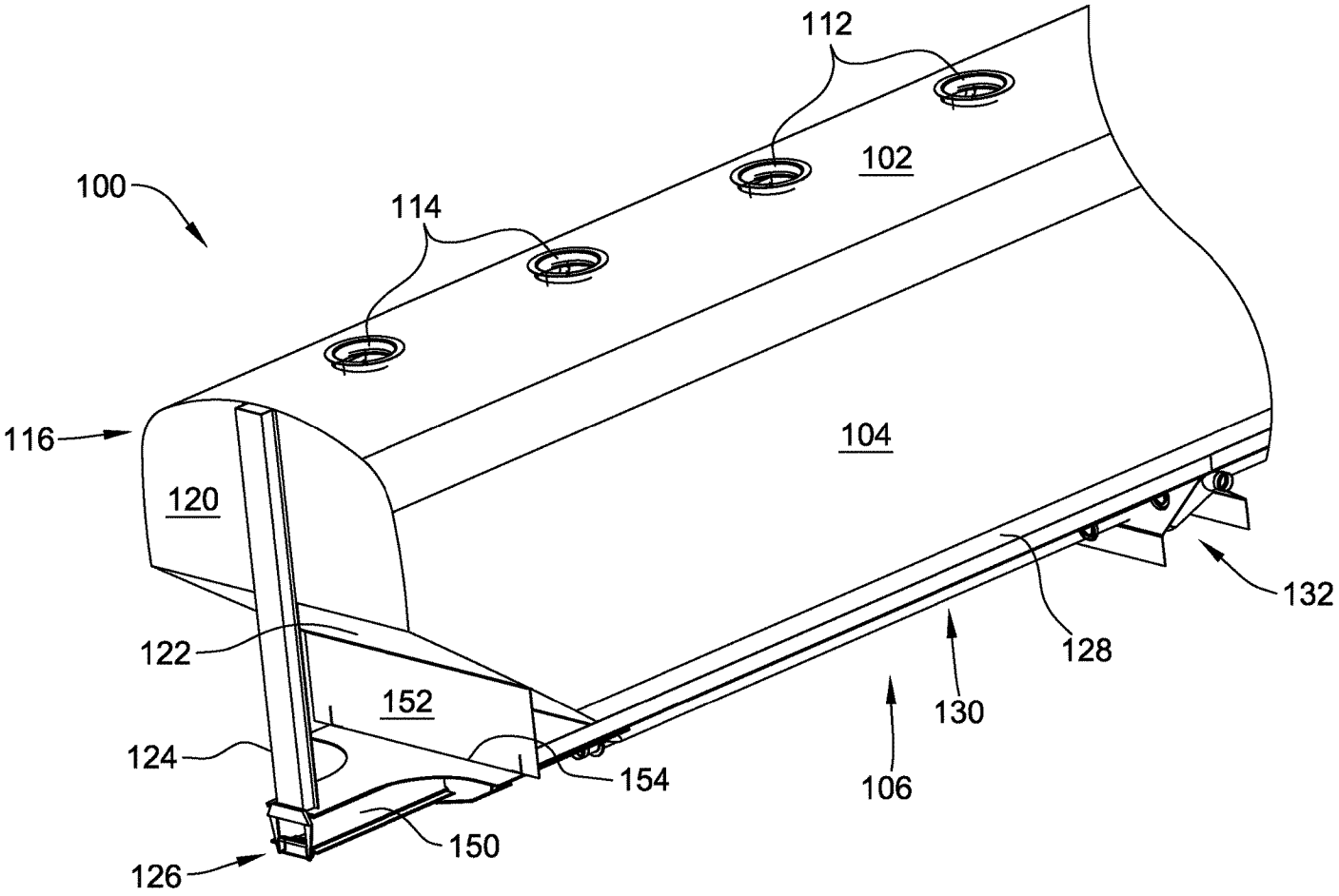
Figure 11:
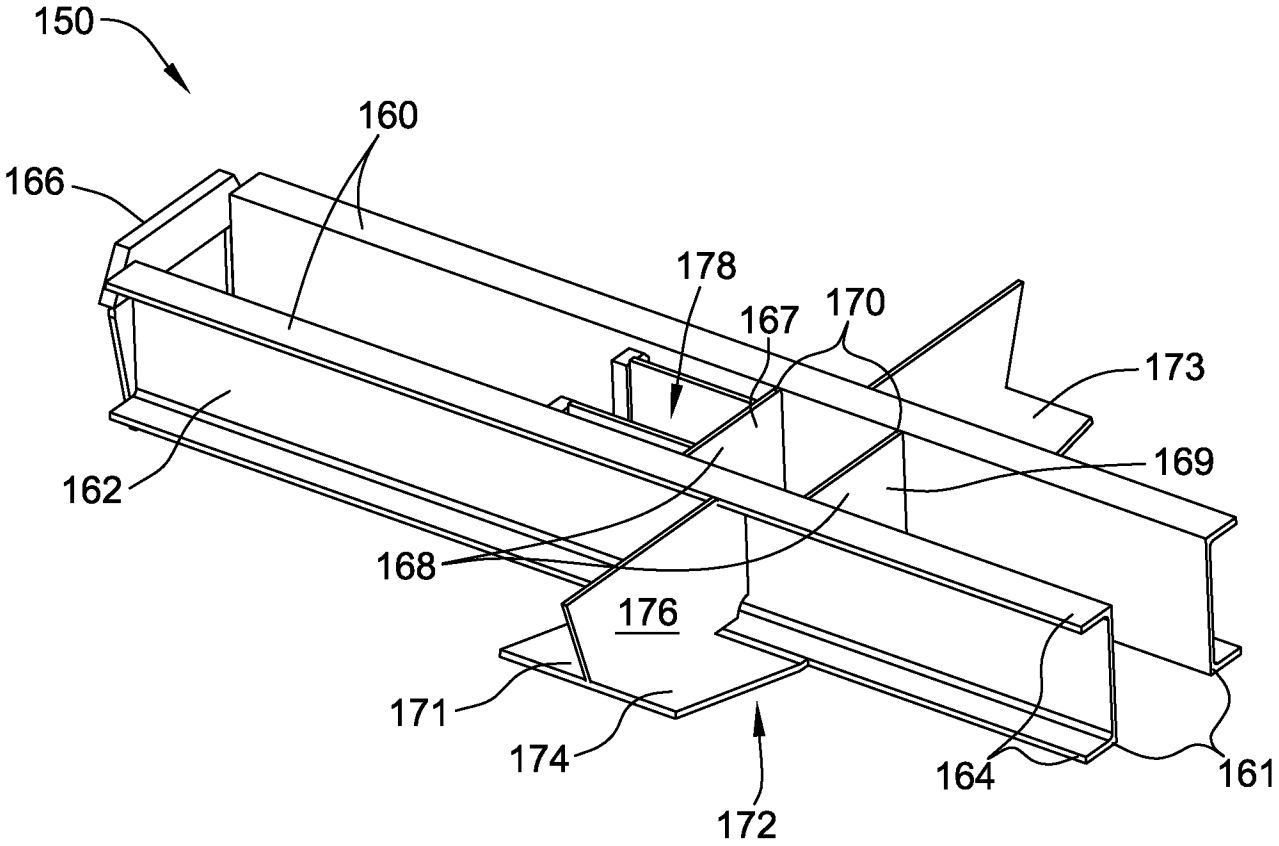
Figure 12:
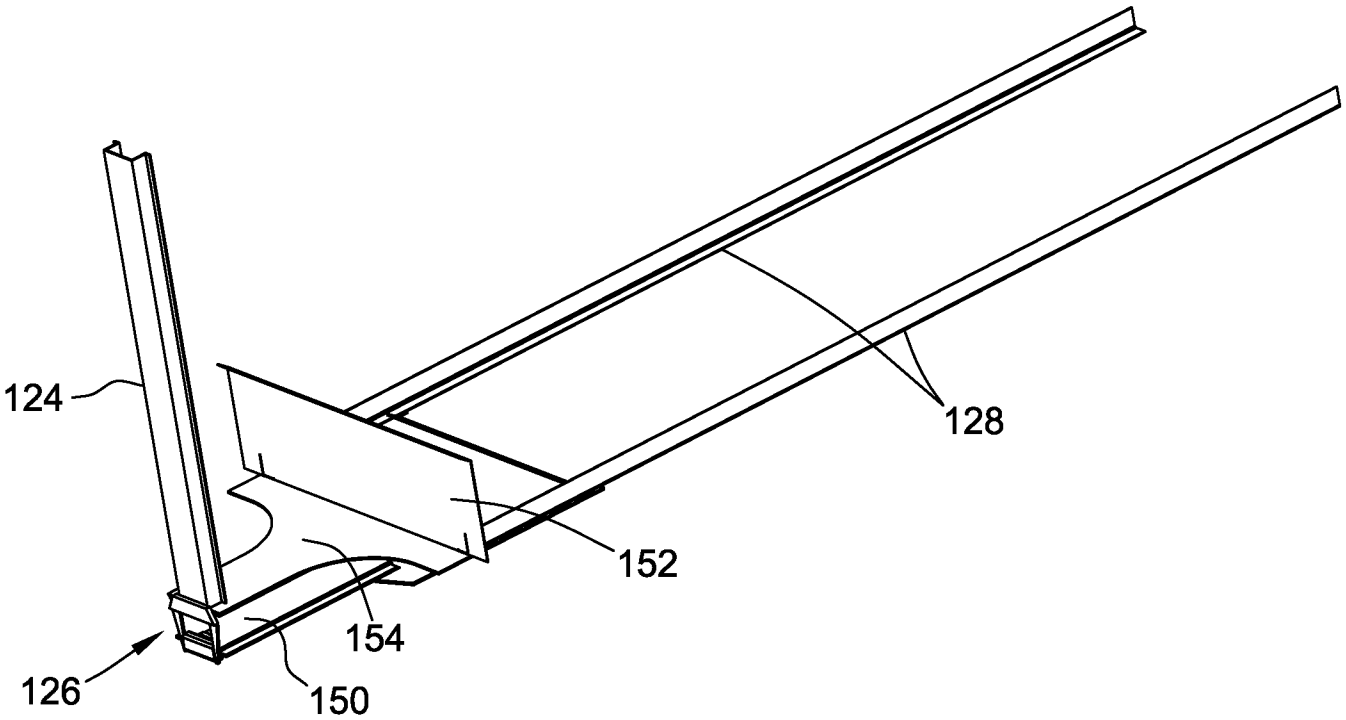
Figure 13:
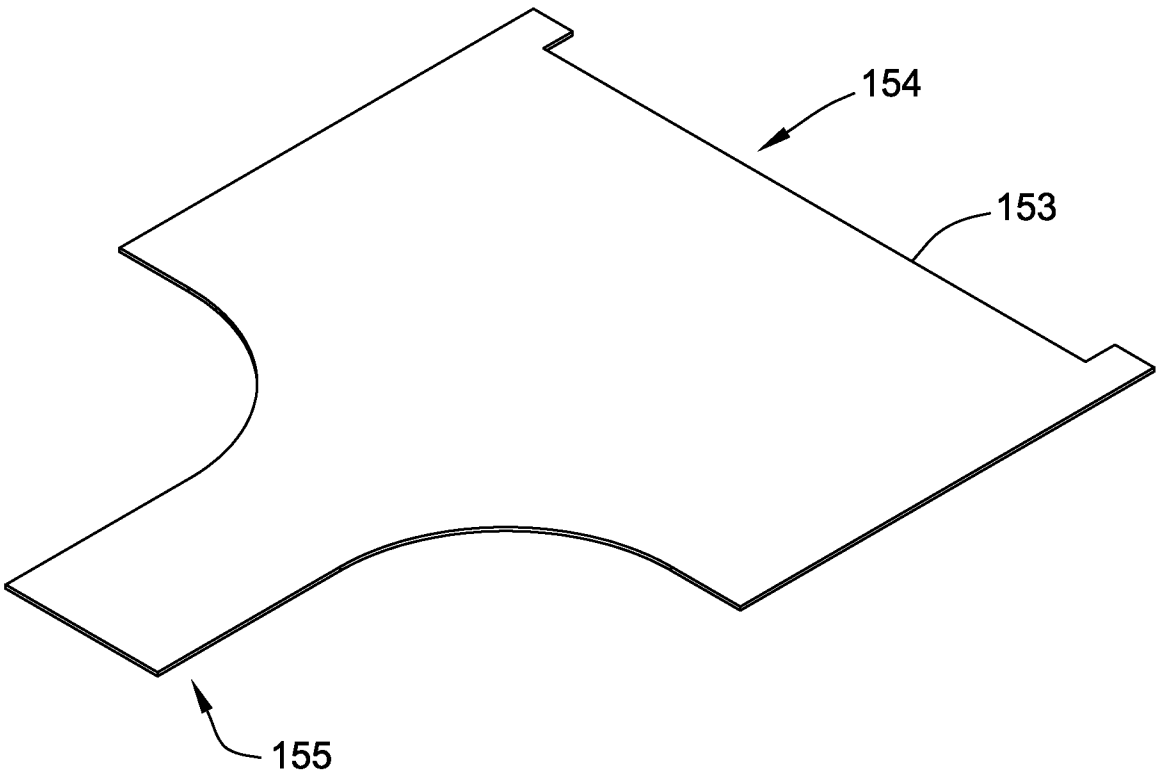

FIG. 10 is a schematic perspective end view of a portion of the railcar 100 shown in FIGS. 1-7. FIG. 11 is a schematic perspective view of an exemplary stub sill subassembly 150 that may be used with the railcar 100 shown in FIGS. 1-7. FIG. 12 is a schematic perspective view of an exemplary underframe assembly 126 that may be used with the railcar 100 shown in FIGS. 1-7. FIG. 13 is a schematic perspective view of an exemplary shear plate 154 that may be used with the underframe assembly 126 shown in FIG. 12. Generally, FIGS. 10-13 show the end structure of the railcar 100 including an underframe assembly 126, which includes a stub sill subassembly 150, an upper vertical bolster web 152, and a shear plate 154 that serve to join adjacent cars 100 together through a coupler assembly (not shown) and to support the car 100 on the rail through a truck and wheel assembly (not shown).

The shear plate 154 is coupled between the top of the stub sill subassembly 150 and the second end of the end post 124. In the exemplary embodiment, the shear plate 154 is coupled to an upper vertical bolster web 152, the side sills 128, and the stub sill subassembly 150. The shear plate 154 is coupled to the upper vertical bolster web 152 approximately midway between opposing inboard and outboard ends 153, 155 of the shear plate 154. As described herein, the term "inboard" may be understood to mean towards the center of the car 100; "outboard" may be understood to mean towards the end of the car 100. At least a portion of the shear plate 154 is removed outboard of the upper vertical bolster web 152 thereby reducing the weight of the shear plate 154. Traditional hopper railcars require substantial shear plate material outboard of the upper vertical bolster because the material serves to shear longitudinal train action loads to the side sill and to provide a base for diagonal stiffeners. However, the hopper railcar 100 described herein does not require diagonal stiffeners, and the longitudinal train action loads are carried by additional shear plate material inboard of the upper vertical web bolster 152. The inboard portion 153 of the shear plate extends inward toward the transverse centerline axis 110 such that an end of the inboard portion 153 is coupled to a portion of the end floor 122. The shear plate 154 is configured to evenly transfer the longitudinal loads of the railcar 100 through the end floor 122 into both the side sills 128 and the bottom assembly 106 and thereby reduce the loads typically carried through the side sills 128.

In the exemplary embodiment, the upper vertical bolster web 152 is a single piece plate that extends between the shear plate 154 and a portion of the end floor 122. The upper vertical bolster webs 152 are configured to provide structural support to the longitudinal ends 116, 118 by transferring vertical loads from other portions of the railcar 100 to the wheel and truck assembly (not shown). The side sills 128 extend across a portion of each shear plate 154 such that the side sills 128 are coupled to the inboard portion 153 of the shear plate 154 and extend substantially between the two opposing upper vertical bolster webs 152 along the longitudinal length of the railcar 100.

As described above, the stub sill subassembly 150 is coupled beneath the shear plate 154 at each of the first and second longitudinal ends 116, 118. The stub sill subassembly 150 includes two substantially similar C-channel beams 160 spaced a distance from one another to define a transverse gap 161 and aligned such that their ends are flush. Each beam 160 includes a side web 162 with upper and lower flanges 164 that extend from the side web 162 in a direction opposite the other beam 160. A striker assembly 166 is coupled across the transverse gap 161 to the ends of the C-channel beams 160 proximate the end post 124 and is configured to provide support for a railcar coupling mechanism (not shown). The stub sill subassembly 150 also includes at least one center plate framing component 168 that extends between the side webs 162 of the C-channel beams 160 across the transverse gap 161. More specifically, each stub sill subassembly 150 includes a front center plate framing component 167 and a rear center plate framing component 169 that are spaced from each other along the C-channel beams 160 to define a longitudinal gap 170.

Furthermore, each stub sill subassembly 150 includes a lower bolster assembly 172 that includes a first portion 171 coupled to one C-channel beam 160 and a second portion 173 coupled to the other C-channel beam 160. Each of the first and second portions 171, 173 include an angled member 174 that extends at a shallow angle from a lower flange 164 of the beam 160 towards an upper flange 164. Each of the first and second lower bolster assembly portions 171, 173 further include an orthogonal member 176 that extends perpendicularly from each respective C-channel side web 162 such that a lower edge of the orthogonal member 176 is coupled to the angled face of the angled member 174. The orthogonal members 176 extend from the side webs 162 at a position between the center plate framing components 168. The lower bolster assembly 172 is coupled to a lower side of the shear plate 154 such that the orthogonal members 176 are substantially aligned with the upper vertical bolster web 152.

Each stub sill subassembly 150 also includes at least one rear draft lug weldment 178. Each rear draft lug weldment 178 extends from the front center plate framing component 167 outboard towards the striker assembly 166 such that each rear draft lug weldment 178 is substantially parallel to the longitudinal centerline axis 108 and the C-channel beams 160. Each rear draft lug weldment 178 is positioned proximate the C-channel side webs 162. Each stub sill subassembly 150 may also include at least one front draft lug weldment (not shown). Each front draft lug weldment extends from the front striker face inboard towards the front center plate framing component 167 such that each front draft lug weldment is substantially parallel to the longitudinal centerline axis 108 and the C-channel beams 160.

In the exemplary embodiment, the C-channel beams 160 in the stub sill subassembly 150 replace the side webs, top covers, and bottom covers of known hopper railcars. The use of C-channel beams 160 reduces not only the amount of structural steel required to manufacture the railcar 100, but also the amount of labor required to weld side webs, top covers, and bottom covers. Accordingly, the C-channel beams 160 provide for a lower cost hopper railcar 100. More specifically, because the C-channel beams 160 include integral top and bottom flanges 164, the railcar 100 described herein provides for significant savings over at least some known railcars by not separately welding the webs and flanges, by not beveling the webs, and by not incurring the welding and associated inspection and correction costs. Generally, the C-channel configuration reduces both plant capital needs and labor requirements, while improving the quality of the railcar 100.

Figure 14:
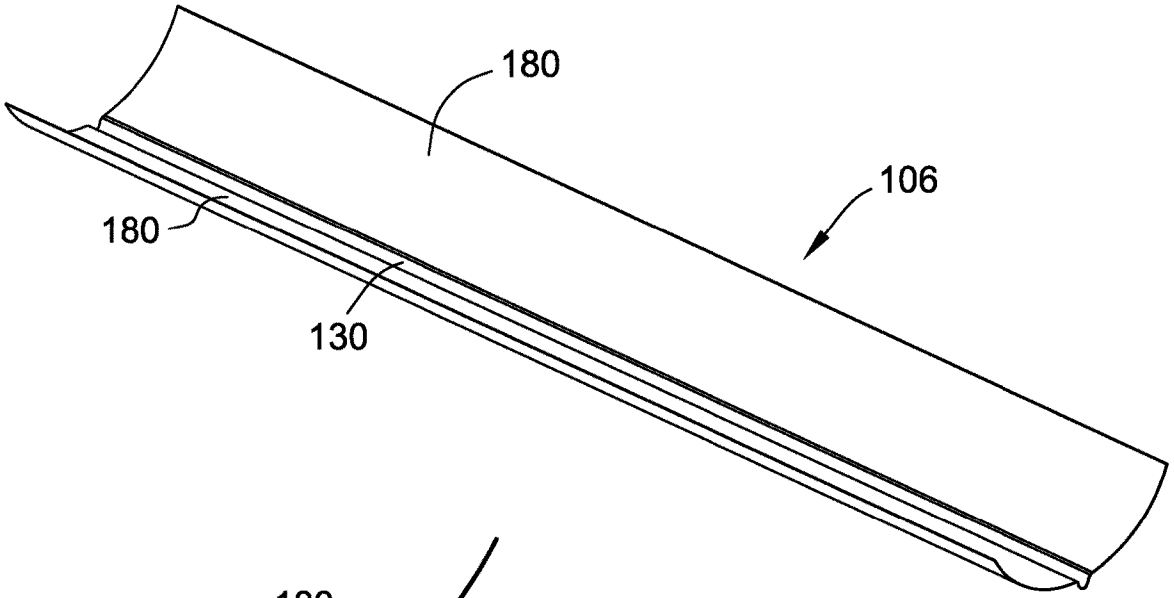
Figure 15:
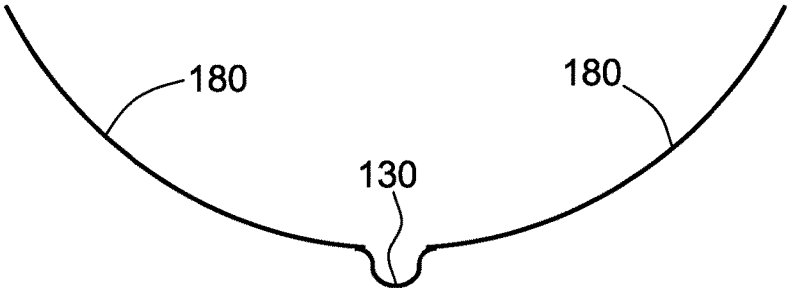

FIG. 14 is a schematic perspective view of an exemplary bottom assembly 106 that may be used with the railcar 100 shown in FIGS. 1-7. FIG. 15 is a schematic end outline view of the bottom assembly 106 shown in FIG. 14. More specifically, FIGS. 14 and 15 show a plurality of bottom side sheets 180 and the trough assembly 130. The plurality of bottom side sheets 180 includes a pair of opposing bottom side sheets 180 coupled tangentially to both the side sills 128 (best shown in FIG. 4) and to the trough assembly 130. The plurality of bottom side sheets 180 is at least partially arcuate such that they form a radius of approximately 54 in. Because the train action loads are at least partially carried by the bottom side sheets 180, they may have a larger thickness than that of the roof portion 102 or side portions 104.

Figure 16:
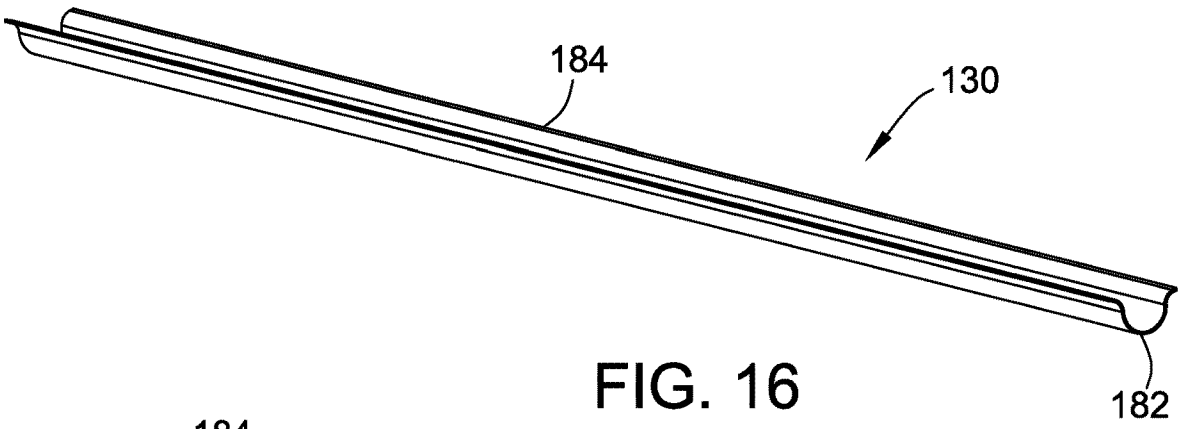
Figure 17:
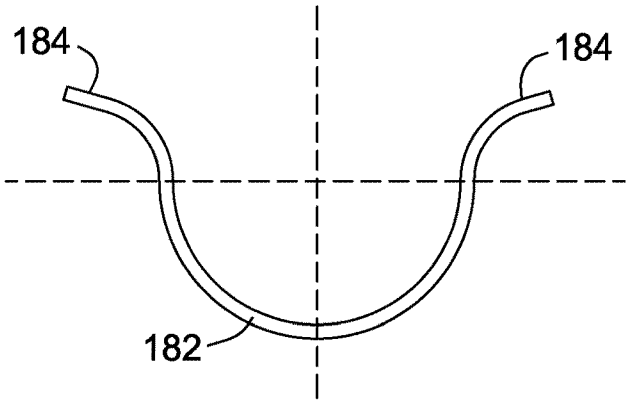

FIG. 16 is a schematic perspective view of an exemplary trough 182 that may be used with the bottom assembly 106 shown in FIG. 14. FIG. 17 is a schematic end view of the trough 182 shown in FIG. 16. The trough assembly 130 is coupled tangentially between the opposing pair of bottom side sheets 180 and includes a trough 182 and opposing flange portions 184 integrally formed at circumferential ends of the trough 182. The flange portions 184 are coupled tangentially to the bottom side sheets 180. In the exemplary embodiment, the trough assembly 130 is manufactured from a 5 in. diameter stainless steel pipe to facilitate ease of welding. Alternatively, the trough assembly 130 may be manufactured from any diameter pipe of any material that facilitates operation of the trough assembly 130 as described herein. The trough assembly 130 extends between the first and second longitudinal ends 116, 118 and is configured to sustain at least a portion of the train action loads as well as a portion of the car bending loads. During the unloading operation, the trough assembly 130 transports the material to the center of the railcar 100 proximate the transverse centerline axis 110, where the material then flows through the material transport system 132 and out of the railcar 100.

Figure 18:
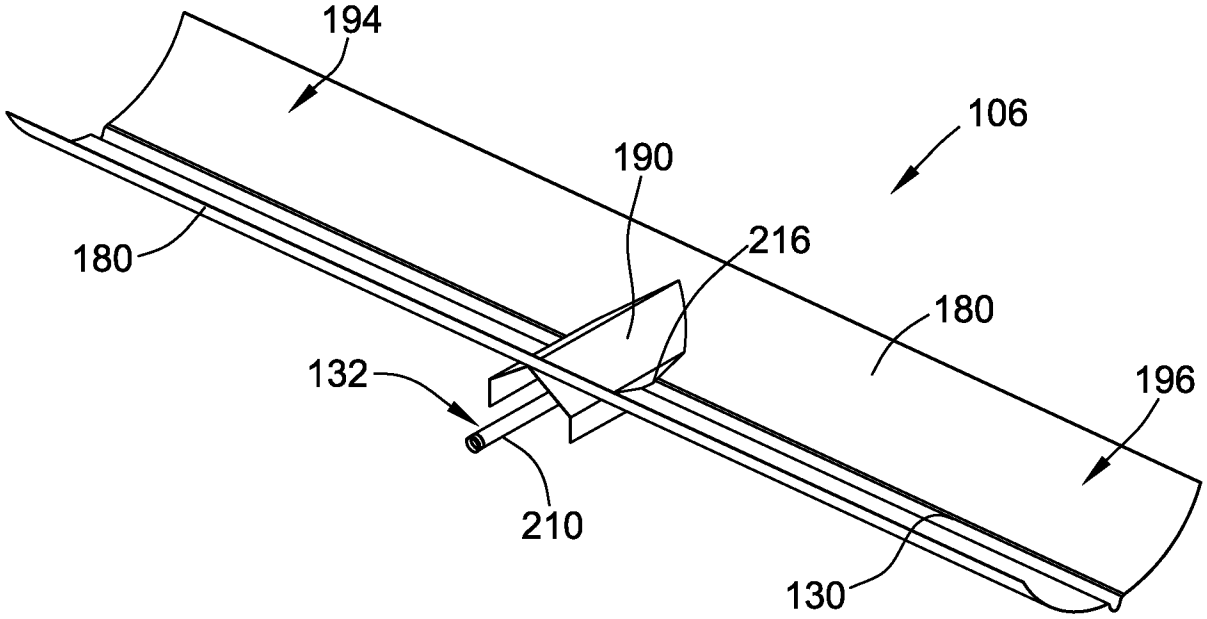
Figure 19:
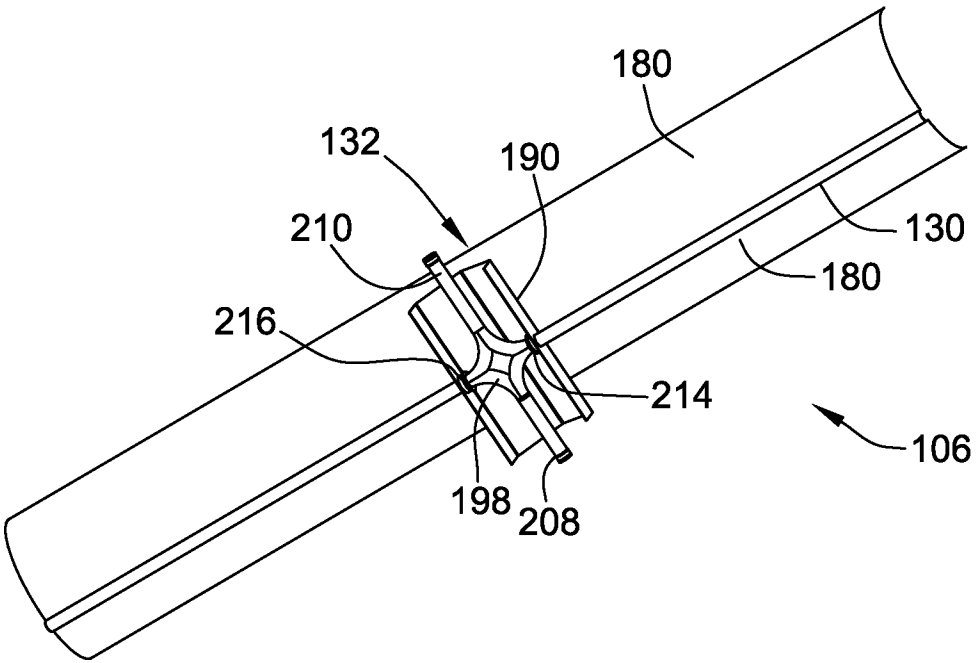
Figure 20:
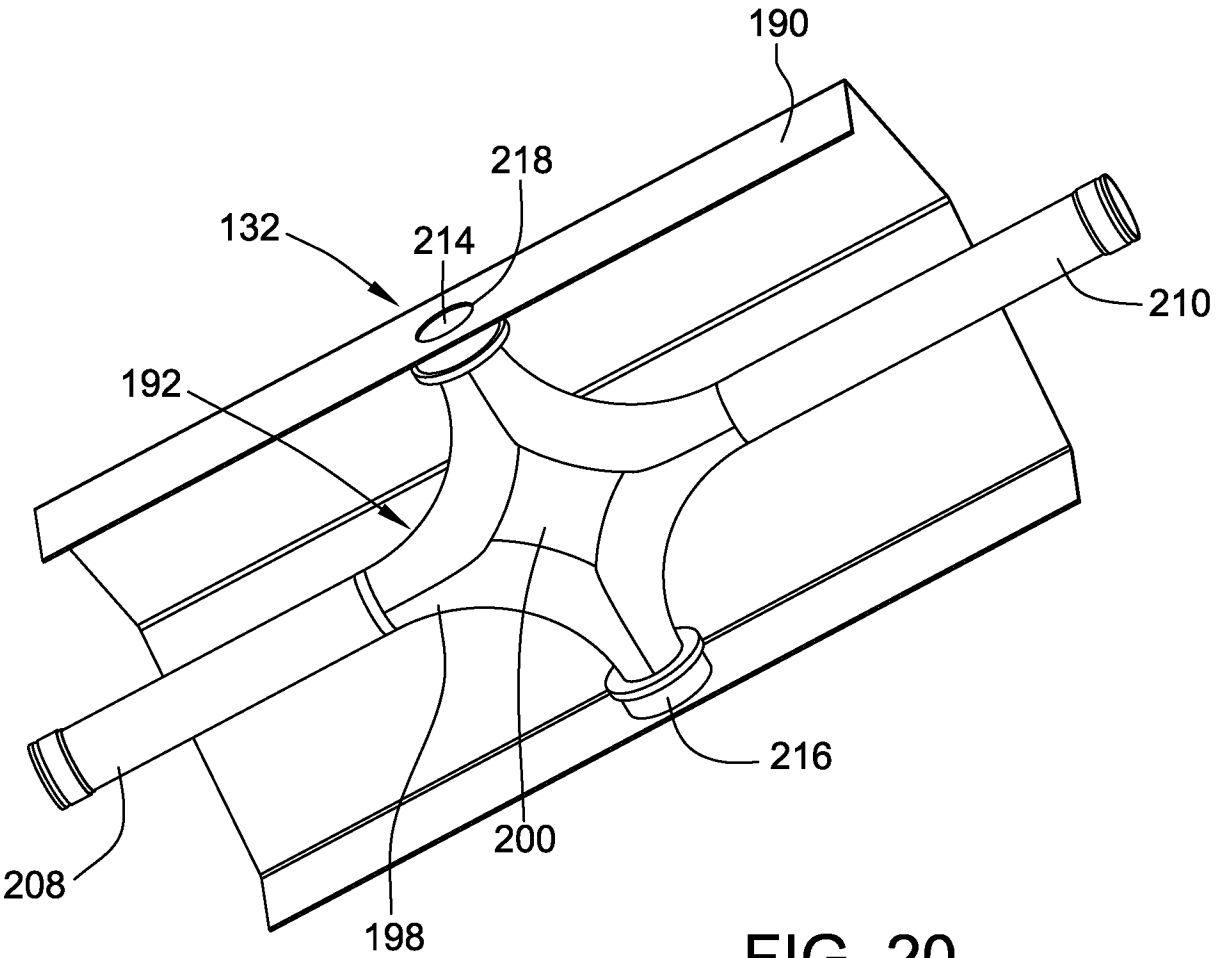
Figure 21:
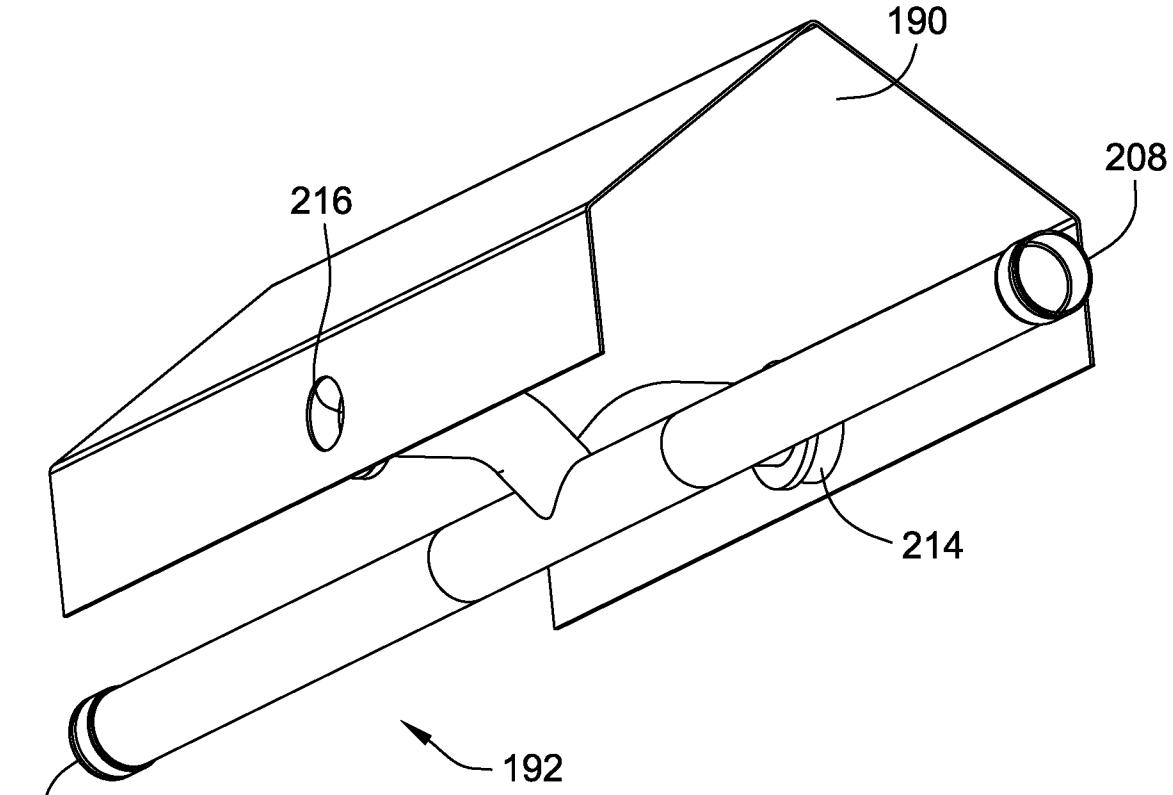
Figure 22:
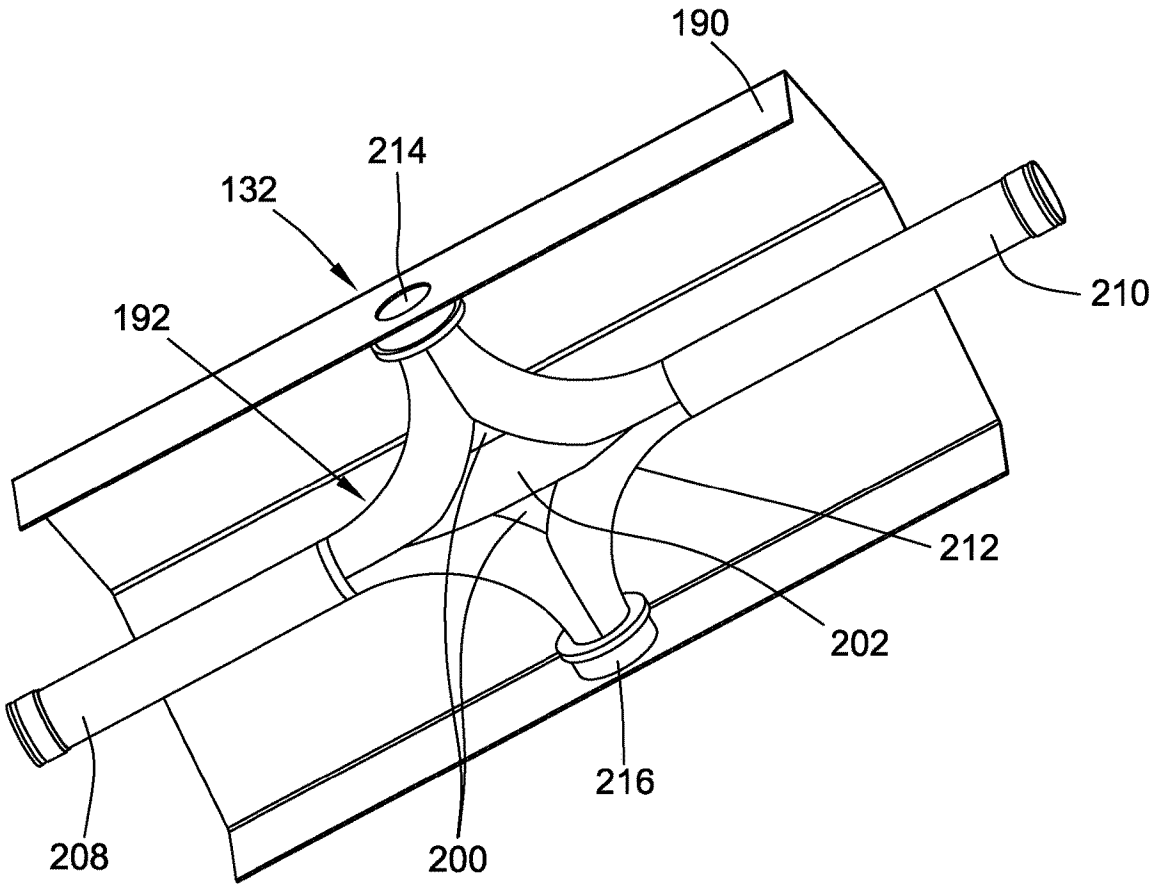

FIG. 18 is a schematic perspective overhead view of a portion of an exemplary material transport system 132 that may be used with the bottom assembly 106 shown in FIG. 14. FIG. 19 is a schematic perspective bottom view of the portion of the material transport system 132 shown in FIG. 18. FIG. 20 is a schematic perspective bottom view of an exemplary piping manifold assembly 192 that may be used with the material transport system 132 shown in FIGS. 18 and 19. FIG. 21 is a schematic perspective view of an alternative piping manifold assembly 192 that may be used with the material transport system 132 shown in FIGS. 18 and 19. FIG. 22 is a schematic perspective view of another alternative piping manifold assembly 192 that may be used with the material transport system 132 shown in FIGS. 18 and 19. The bottom assembly 106 includes a partition hood 190 that is coupled to the bottom side sheets 180 at least partially within the material transport cavity 138 such that opposing distal ends of the partition hood 190 extend to the bottom side sheets 180. Support brackets (not shown) are coupled to the exterior of the railcar 100 and aligned with the partition hood 190 to further support a piping manifold assembly 192. The partition hood 190 is positioned at and substantially parallel to the transverse centerline axis 110 such that the partition hood 190 divides the material transport cavity 138 of the railcar into a first cavity portion 194 in the first longitudinal end 116 and a second cavity portion 196 in the second longitudinal end 118. The partition hood 190 is configured to divert the solid flowable material into one of the first cavity portion 194 or the second cavity portion 196 to ensure a maximum clean-out of the entire cavity 138.

In the exemplary embodiment, the material transport system 132 includes the piping manifold assembly 192 that is coupled in flow communication with the trough assembly 130 beneath the partition hood 190. Alternatively, the partition hood 190 and piping manifold assembly 192 may be positioned at any point along the longitudinal length of the railcar 100 that facilitates operation of the material transport system 132 as described herein. The piping manifold assembly 192 divides the trough assembly 130 into a first trough portion 204 that corresponds to the first cavity portion 194 in the first longitudinal end 116 and a second trough portion 206 that corresponds to the second cavity portion 196 in the second longitudinal end 118. The first trough portion 204 extends from the piping manifold assembly 192 to the first longitudinal end 116 and the second trough portion 206 extends from the piping manifold assembly 192 to the second longitudinal end 118.

The piping manifold assembly 192 includes a four-way junction 198 that includes a first valve 214, an opposing second valve 216, an air supply pipe 208, and an opposing material discharge pipe 210. In the exemplary embodiment, first and second valves 214, 216 are butterfly valves that may be manually or pneumatically operated. Alternatively, first and second valves 214, 216 may be any type of valve operated in any manner that facilitates operation of the material transport system 132 as described herein. The first and second valves 214, 216 are oriented parallel to the longitudinal centerline axis 108 and extend between longitudinally opposed ends of the four-way junction 198 and respective openings in the partition hood 190. The first valve 214 is coupled in flow communication with the first trough portion 204 through a first hood opening 218, and the second valve 216 is coupled in flow communication with the second trough portion 206 through a second hood opening (not shown). During operation, the first and second valves 214, 216 are configured to sequentially channel air from the material transport cavity 138, and subsequently to facilitate channeling the solid flowable material from the cavity 138 and out of the railcar 100.

Similarly to the first and second valves 214, 216, the air supply pipe 208 and the material discharge pipe 210 are coupled to the four-way junction 198 opposite each other. However, the air supply pipe 208 and the material discharge pipe 210 are both oriented parallel to the transverse centerline axis 110 and extend from the four-way junction 198 to beyond the distal ends of the partition hood 190. The material discharge pipe 210 is coupled in flow communication with a material receiving system (not shown) and is configured to transport the solid flowable material from the railcar 100. The air supply pipe 208 is coupled in flow communication with an air source and is configured to channel bypass air through the four-way junction 198 to induce a flow of the solid flowable material through the trough assembly 130 and out of the railcar 100 through the material discharge pipe 210.

In the exemplary embodiment, shown in FIG. 20, the material discharge pipe 210 and air supply pipe 208 are straight pipes having a centerline approximately 19 in. above the rail (not shown). Furthermore, the exemplary four-way junction 198 includes a middle void 200 that does not allow air from the air supply pipe 208 to flow directly into the material discharge pipe 210 without turning toward one of first or second valve 214, 216. Alternatively, as shown in FIG. 21, the material discharge pipes may be curved which enables the material to be dropped into the air flow stream. In yet another embodiment, shown in FIG. 22, a four-way junction 212 similar to that shown in FIG. 20 includes a straight bypass pipe 202 that joins the air supply pipe 208 to the material discharge pipe 210 through the void 200 between the first and second valves 214, 216. The bypass pipe 202 facilitates channeling a portion of the air directly between the air supply pipe 208 and the material discharge pipe 210, thus allowing air to flow past the valves 214, 216 to suspend the material within the air stream during material removal. Generally, the four-way junction 198, 212 of the material transport system 132 may have any combination of the features described above.

Figure 23:
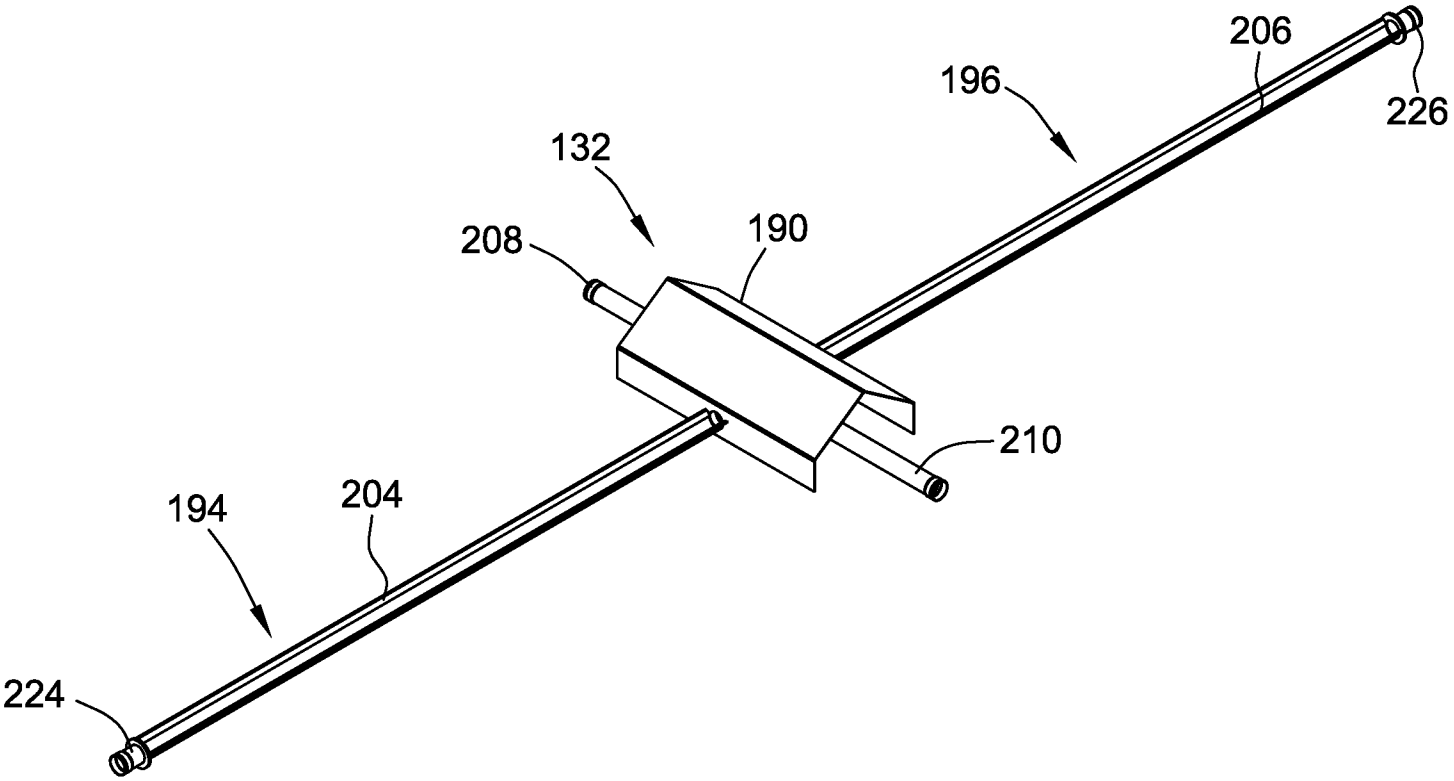
Figure 24:
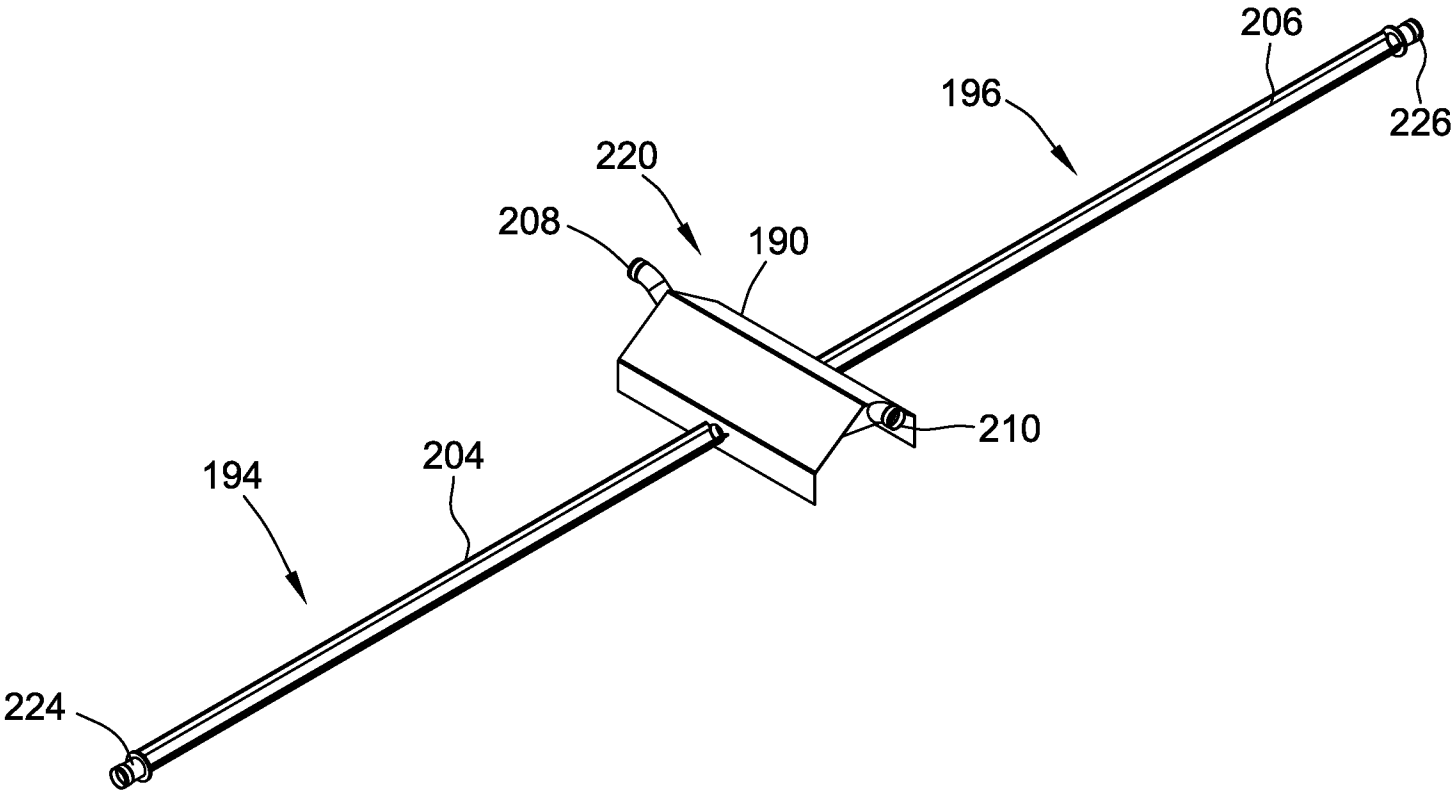

FIG. 23 is a schematic perspective overhead view of the exemplary material transport system 132 shown in FIGS. 18 through 20 illustrating a first trough vent assembly 224 coupled to the first trough portion 204 and the first longitudinal end 116, and a second trough vent assembly 226 coupled to the second trough portion 206 and the second longitudinal end 118. FIG. 24 is a schematic perspective overhead view of an alternative material transport system 220 that may be used with the bottom assembly 106 shown in FIG. 18 and the alternative piping manifold assembly 192 with four-way junction 212 shown in FIG. 21.

The first and second vent trough assemblies 224, 226 are configured to place respective first and second portions 204, 206 of the trough assembly 130 in flow communication with the atmosphere outside the railcar 100 to provide bypass air to the trough assembly 130 during removal of the solid flowable material from the material transport cavity 138. The bypass air facilitates keeping the material fluidized and moving towards the first and second valves 214, 216 for removal. Additionally, the primary loading openings 112 described above include vents that enable airflow therethrough and work in conjunction with the bypass air from the trough vent assemblies 224, 226 to prevent forming a vacuum inside the cavity 138 when the material transport system 132 is operating.

In the exemplary embodiment, the valve 214, 216 on each trough vent assembly 224, 226 is a continuously venting valve that enables air exchange into or out of the material transport cavity 138, similar to the vented primary loading openings 112. Alternatively, the vent assembly 224, 226 may be a check valve that acts as a vacuum relief valve such that air is allowed into the cavity 138 but not out. Furthermore, the vent assembly 224, 226 may be configured as a combination check valve and gate valve, wherein the gate valve is closed during the initial stages of unloading to restrict air flow into the material transport cavity 138 and subsequently opens to enable the check valve portion to draw bypass air into the trough assembly 130.

Also disclosed herein is a method of unloading the solid flowable material from the material transport cavity 138. During unloading, the material transport system 132 facilitates unloading one of the first or second cavity portions 194, 196 at a time until the initially unloaded portion 194, 196 is empty or until a measured material transfer rate decreases to a predetermined amount, at which time the remaining portion 194, 196 of the cavity 138 is unloaded. In the exemplary embodiment, the first portion 194 of the material transport cavity 138 is initially unloaded followed by the second cavity portion 196. Alternatively, the second portion 196 of the material transport cavity 138 may be initially unloaded followed by the first cavity portion 194.

The method includes coupling the air source to the air supply pipe 208 of the piping manifold assembly 192. The first valve 214 is then opened and the second valve 216 is closed such that the first cavity portion 194 is coupled in flow communication with the first trough portion 204 through the material. Gravity feed of the material into the trough assembly 130 enables material to be drawn through the first valve 214 using bypass air from the air supply pipe 208. More specifically, the bypass air flowing through the piping manifold assembly 192 fluidizes the solid flowable material exiting the first cavity portion 194 proximate the first trough portion 204. The first trough vent assembly 224 may then be opened to facilitate channeling additional air external to the railcar 100 into the first trough portion 204 to keep the material fluidized during removal from the cavity 138. A flow of the material is then transported from the first trough portion 204 through the first valve 214 and the material discharge pipe 210 to the material receiving system (not shown). Operation of the material transport system 132 is maintained until the system is no longer removing the material from the first cavity portion 194 or until a measured material transfer rate decreases to a predetermined amount.

Once the first cavity portion 194 has been sufficiently emptied, the material transport system 132 is shut off to prepare the second cavity portion 196 for unloading. The first step in unloading the second portion 196 of the material transport cavity 138 is to close the first valve 214 and open the second valve 216 of the material transport system 132. Similar to the unloading of the first cavity portion 194, the air source supplies bypass air to the piping manifold assembly 192 to fluidize the material in the second cavity portion 196. The second trough vent assembly 226 may then be opened to channel air external to the railcar 100 into the second trough portion 206 to keep the material fluidized during removal from the cavity 138. A flow of the material is then transported from the second trough portion 206 to the material receiving system (not shown). More specifically, the material is channeled from the second trough portion 206 through the second valve 216 and the material discharge pipe 210 of the piping manifold assembly 192 to the material receiving system. As the second cavity portion 196 is unloaded, a portion of the solid flowable material may shift over the partition hood 190 to the first cavity portion 194. Accordingly, to effectuate maximum removal of the material from the material transport cavity 138, the first and/or second cavity portions 194, 196 may need to be coupled to the material receiving system more than once.

Exemplary embodiments of a covered hopper railcar and methods of assembling and operating the same are described above in detail. The covered hopper railcar and methods are not limited to the specific embodiments described herein, but rather, components of apparatus and/or steps of the methods may be utilized independently and separately from other components and/or steps described herein. For example, the general features of the covered hopper railcar may also be used in combination with other railcars and associated assembly and operation methods, and are not limited to practice with only the railcar and assembly and operation methods as described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A covered hopper railcar comprising:

a roof portion;

a plurality of side portions coupled to said roof portion, said plurality of side portions and said roof portion at least partially define a longitudinal centerline axis; and a bottom assembly coupled to said side portions, said bottom assembly comprising:

a plurality of bottom side sheets;

a trough assembly coupled to said plurality of bottom side sheets, wherein said trough assembly is substantially parallel to and substantially aligned with the longitudinal centerline axis; and a material transport system comprising a piping manifold coupled to said trough assembly.

2. The railcar in accordance with claim 1, wherein said bottom side sheets are at least partially arcuate.

3. The railcar in accordance with claim 1, wherein said roof portion, said plurality of side portions, and said bottom assembly define a cavity therein, said cavity configured to contain a solid flowable material.

4. The railcar in accordance with claim 1, wherein said bottom assembly defines a lower longitudinal length, wherein said trough assembly has a length value that is substantially equal to the lower longitudinal length.

5. The railcar in accordance with claim 4 further comprising:

a plurality of side sills coupled to said plurality of bottom side sheets;

a first longitudinal end and a second longitudinal end, wherein said plurality of side sills extends between said first longitudinal end and said second longitudinal end; and a transverse centerline axis substantially perpendicular to the longitudinal centerline axis and positioned substantially mid-way between said first and second longitudinal ends.

6. The railcar in accordance with claim 5, wherein each of said first longitudinal end and said second longitudinal end comprises:

an end wall coupled to said roof portion and said plurality of side portions, said end wall is substantially vertical;

an end floor coupled to said end wall at a predetermined angle such that said end floor is sloped downward and inward toward said trough assembly; and a support member coupled to said end wall, said support member substantially parallel to said end wall.

7. The railcar in accordance with claim 6 further comprising:

an underframe assembly coupled to said support member, said underframe assembly comprising:

a stub sill subassembly comprising:

opposing C-channel beams spaced apart by a gap;

a striker assembly coupled to the ends of said C-channel beams across said gap;

front and rear center plate framing components coupled between said C-channel beams;

front and rear draft lug weldments coupled to respective said front and rear center plate framing components; and a lower bolster assembly coupled said opposing C-channel beams; and a shear plate coupled to said stub sill subassembly, said end floor, and said plurality of side sills, wherein said shear plate is configured to transfer a portion of its loads to said bottom assembly and thereby decrease loads in said plurality of side sills.

8. The railcar in accordance with claim 7, wherein a load path is defined between said plurality of side sills and said trough assembly such that said trough assembly is configured to sustain at least a portion of car body loads induced thereon by train action forces and also by a solid flowable material.

9. The railcar in accordance with claim 8, wherein said load path is defined sequentially by said plurality of side sills, said shear plate, said stub sill subassembly, said support member, said end wall, said end floor, said bottom side sheets, and said trough assembly.

10. The railcar in accordance with claim 1 further comprising a first longitudinal end and a second longitudinal end, wherein:

said trough assembly extends between said first longitudinal end and said second longitudinal end; and said trough assembly defines a first trough portion extending from said piping manifold toward said first longitudinal end and a second trough portion extending from said piping manifold toward said second longitudinal end.

11. The railcar in accordance with claim 10, wherein said piping manifold further comprises a first valve coupled to said first trough portion and a second valve coupled to said second trough portion.

12. The railcar in accordance with claim 10, wherein said piping manifold further comprises at least one transport pipe configured to transport a solid flowable material from said railcar.

13. The railcar in accordance with claim 10, wherein said piping manifold further comprises at least one air supply pipe coupled to an air source, said at least one air supply pipe configured to transport bypass air to said material transport pipe.

14. The railcar in accordance with claim 13, wherein said piping manifold further comprises at least one air supply pipe coupled to an air source, said at least one air supply pipe configured to transport air through said piping manifold to induce flow of a solid flowable material though said material discharge pipe.

15. The railcar in accordance with claim 10 further comprising:

a first trough vent assembly coupled to said first trough portion and said first longitudinal end; and a second trough vent assembly coupled to said second trough portion and said second longitudinal end.

16. The railcar in accordance with claim 1, wherein said roof portion defines a plurality of material loading openings comprising:

at least one primary material loading opening positioned proximate the transverse centerline axis; and a plurality of secondary material loading openings positioned longitudinally at predetermined distances from said at least one primary material loading openings.

17. A covered hopper railcar comprising:

a roof portion;

a plurality of side portions coupled to said roof portion, said plurality of side portions and said roof portion at least partially define a longitudinal centerline axis; and a bottom assembly coupled to said side portions, wherein each of said roof portion, said plurality of side portions, and said bottom assembly have an interior surface, said railcar further comprising a plurality of hoops coupled to said interior surfaces, said bottom assembly comprising:

a plurality of bottom side sheets; and a trough assembly coupled to said plurality of bottom side sheets, wherein said trough assembly is substantially parallel to and substantially aligned with the longitudinal centerline axis.

18. The railcar in accordance with claim 17, wherein said bottom side sheets are at least partially arcual.

19. The railcar in accordance with claim 17, wherein said roof portion, said plurality of side portions, and said bottom assembly define a cavity therein, said cavity configured to contain a solid flowable material.

20. The railcar in accordance with claim 17, wherein said bottom assembly defines a lower longitudinal length, wherein said trough assembly has a length value that is substantially equal to the lower longitudinal length.

21. The railcar in accordance with claim 20 further comprising:

a plurality of side sills coupled to said plurality of bottom side sheets;

a first longitudinal end and a second longitudinal end, wherein said plurality of side sills extends between said first longitudinal end and said second longitudinal end; and a transverse centerline axis substantially perpendicular to the longitudinal centerline axis and positioned substantially mid-way between said first and second longitudinal ends.

22. The railcar in accordance with claim 21, wherein each of said first longitudinal end and said second longitudinal end comprises:

an end wall coupled to said roof portion and said plurality of side portions, said end wall is substantially vertical;

an end floor coupled to said end wall at a predetermined angle such that said end floor is sloped downward and inward toward said trough assembly; and a support member coupled to said end wall, said support member substantially parallel to said end wall.

23. The railcar in accordance with claim 22 further comprising:

an underframe assembly coupled to said support member, said underframe assembly comprising:

a stub sill subassembly comprising:

opposing C-channel beams spaced apart by a gap;

a striker assembly coupled to the ends of said C-channel beams across said gap;

front and rear center plate framing components coupled between said C-channel beams;

front and rear draft lug weldments coupled to respective said front and rear center plate framing components; and a lower bolster assembly coupled said opposing C-channel beams; and a shear plate coupled to said stub sill subassembly, said end floor, and said plurality of side sills, wherein said shear plate is configured to transfer a portion of its loads to said bottom assembly and thereby decrease loads in said plurality of side sills.

24. The railcar in accordance with claim 23, wherein a load path is defined between said plurality of side sills and said trough assembly such that said trough assembly is configured to sustain at least a portion of car body loads induced thereon by train action forces and also by a solid flowable material.

25. The railcar in accordance with claim 24, wherein said load path is defined sequentially by said plurality of side sills, said shear plate, said stub sill subassembly, said support member, said end wall, said end floor, said bottom side sheets, and said trough assembly.

26. The railcar in accordance with claim 17, wherein said hoop defines a closed loop.

* * * * *